US011344166B2

(12) United States Patent
Hirasawa et al.

(10) Patent No.: US 11,344,166 B2
(45) Date of Patent: May 31, 2022

(54) TOILET SEAT DEVICE

(71) Applicant: LIXIL Corporation, Tokyo (JP)

(72) Inventors: Isato Hirasawa, Tokyo (JP); Saori Ichihara, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

(21) Appl. No.: 17/041,402

(22) PCT Filed: Mar. 19, 2019

(86) PCT No.: PCT/JP2019/011515
§ 371 (c)(1),
(2) Date: Sep. 24, 2020

(87) PCT Pub. No.: WO2019/188600
PCT Pub. Date: Oct. 3, 2019

(65) Prior Publication Data

US 2021/0022568 A1 Jan. 28, 2021

(30) Foreign Application Priority Data

Mar. 27, 2018 (JP) ..... JP2018-059758
Mar. 27, 2018 (JP) ..... JP2018-059759

(51) Int. Cl.
*A47K 13/12* (2006.01)
*A47K 13/26* (2006.01)

(52) U.S. Cl.
CPC ..... *A47K 13/12* (2013.01); *A47K 13/26* (2013.01)

(58) Field of Classification Search
CPC ..... A47K 13/12; A47K 13/26
USPC ..... 4/236
See application file for complete search history.

(56) References Cited

U.S. PATENT DOCUMENTS 3,471,874 A * 10/1969 Dixon ..... A47K 13/12 4/240
5,749,104 A * 5/1998 Evans ..... A47K 13/06 4/239
8,091,154 B2 * 1/2012 Allen ..... A47K 13/12 4/240
11,026,547 B2 * 6/2021 Arndt ..... A47K 13/26

FOREIGN PATENT DOCUMENTS

JP H10-148052 A 6/1998
JP 2000-166813 A 6/2000
JP 2007-111189 A 5/2007
(Continued)

*Primary Examiner* — Christine J Skubinna
(74) *Attorney, Agent, or Firm* — Morrison & Foerster LLP

(57) ABSTRACT

A toilet seat device includes a main body installed at an upper rear part of a toilet, a toilet seat attached to the main body, and a toilet lid. The toilet lid includes a toilet lid main body configured to cover the toilet seat; and a first shaft engagement part attached to the toilet lid main body and attachable to and detachable from a first shaft provided on the main body. The first shaft engagement part is configured to be switchable between an engaged state in which the first shaft engagement part is engaged with the first shaft and a non-engaged state in which the engagement with the first shaft is released and is switched to the non-engaged state when the toilet lid main body in the engagement state is pressed in a direction in which the toilet lid main body moves away from the toilet seat.

10 Claims, 18 Drawing Sheets

(56) References Cited

FOREIGN PATENT DOCUMENTS

| | | | |
|---|---|---|---|
| JP | 2017-124116 | A | 7/2017 |
| KR | 10-2006-0112552 | A | 11/2006 |
| WO | 2006/115322 | A1 | 11/2006 |

* cited by examiner

TOILET SEAT DEVICE

CROSS-REFERENCE TO RELATED APPLICATIONS

This application is a national stage application under 35 USC 371 of International Application No. PCT/JP2019/011515, filed Mar. 19, 2019, which claims the priority of Japanese Application No. 2018-059758, filed Mar. 27, 2018, and Japanese Application No. 2018-059759, filed Mar. 27, 2018, the entire contents of each of which are incorporated herein by reference.

FIELD OF THE DISCLOSURE

The present disclosure relates to a toilet seat device.

BACKGROUND OF THE DISCLOSURE

A toilet seat device which has a toilet lid provided on a toilet and configured to open and close an upper part of a toilet seat is known. A toilet lid is configured to be detachably locked to a main body installed on an upper rear part of a toilet.

Such a toilet seat device has an advantage in that cleaning is capable of being easily performed by detaching a toilet lid from a main body at the time of cleaning.

As an attaching-detaching mechanism of a toilet lid in the toilet seat device, for example: a mechanism in which a toilet lid is attached to or detached from the main body by deforming a toilet lid such as by an elastic deformation, e.g., by making a toilet lid to deflect; and a switching mechanism including a lever provided at the toilet seat device and switching a state of locking the lid to the main body and a state of being released the lock by switching the lever, are known (for example, refer to Patent Document 1 and Patent Document 2).

Generally, a toilet lid is not intended to be used as a backrest by a user who is sitting on a toilet seat. However, a user may lean against a toilet lid like a backrest and a load may be applied to the toilet lid in some cases.

For this reason, measures are taken so that a toilet lid also has sufficient strength such that the toilet lid does not break when a user leans against the toilet lid or a toilet lid is disposed further rearward to prevent a user from leaning against the toilet lid.

Patent Document 1: Japanese Unexamined Patent Application, First Publication No. 2017-124116

Patent Document 2: Japanese Unexamined Patent Application, First Publication No. 2007-111189

SUMMARY OF THE DISCLOSURE

In a toilet seat device in which a toilet lid is attached to and detached from a main body by elastically deforming the toilet lid, it may be necessary to have sufficient strength by which elastic deformation is capable of being withstood at the time of attachment/detachment, in addition to strength based on the original function of the toilet lid. Thus, a large force is required for elastic deformation at the time of attachment-detachment.

In a toilet seat device which switches between a state in which a toilet lid is locked to a main body and a state in which the locking is released using a lever, since an operation of the lever and an operation of attaching and detaching the toilet lid need to be performed at the same time, the operations are complicated.

If priority is given to a material of a toilet lid and a shape of the toilet lid, it may not be possible to make the toilet lid have sufficient strength so that the toilet lid does not break though a user leans against the toilet lid. Furthermore, if a structure in which the toilet lid is easily removed from a main body is provided, in a case that a load is applied to the toilet lid other than when a user leans against the toilet lid, for example, cleaning, there is concern that the toilet lid may be removed from the main body. In addition, it may be impossible to install the toilet lid further rearward in terms of a design and a shape.

Therefore, a first aspect of the present disclosure is to provide a toilet seat device in which a toilet lid is capable of being easily attached to and detached from a main body installed at an upper rear part of a toilet.

A second aspect of the present disclosure is to provide a toilet seat device in which a toilet lid is capable of being prevented from becoming broken when a user leans against a toilet lid regardless of a design and a material.

A toilet seat device according to some embodiments of the present disclosure includes a main body installed at an upper rear part of a toilet; a toilet seat attached to the main body; and a toilet lid configured to open and close an upper part of the toilet seat, wherein the toilet lid includes: a toilet lid main body configured to close the upper part of the toilet seat; and a shaft engagement part which is attached to the toilet lid main body and is attachable to and detachable from a shaft provided on the main body, the shaft engagement part is configured to be switchable between an engaged state in which the shaft engagement part is engaged with the shaft and a non-engaged state in which the engagement with the shaft is released, and when the toilet lid main body is pressed in a direction in which the toilet lid main body moves away from the toilet seat in the engaged state, the shaft engagement part is switched to the non-engaged state.

According to the above, the shaft engagement part in an engaged state attached to the toilet lid main body is switched to a non-engaged state when the toilet lid main body is pressed in a direction in which the toilet lid main body moves away from the toilet seat. Thus, a user can easily switch the shaft engagement part in an engaged state to a non-engaged state by pressing the toilet lid main body in the direction in which the toilet lid main body moves away from the toilet seat.

Since the toilet lid in which the shaft engagement part is in a non-engaged state is capable of being easily attached to and detached from the shaft, the toilet lid is capable of being easily attached to and detached from the main body.

According to some embodiments of the present disclosure, in the toilet seat device according to some embodiments, the shaft engagement part may have a biasing portion configured to perform biasing so that a posture is changed from a posture in the non-engaged state to a posture in the engaged state.

According to the above, when pressing of the toilet lid main body in the direction in which the toilet lid main body moves away from the toilet seat is stopped, the shaft engagement part is capable of being easily switched in a non-engaged state to an engaged state.

According to a some embodiments of the present disclosure, in the toilet seat device according to some embodiments, the shaft engagement part may include: a concave part opened downward and configured such that the shaft is capable of being put in and put out from a lower side, the concave part being configured to be capable of accommodating the shaft; and a movable portion configured to be movable, the movable portion closing a lower portion of the concave part to be in the engaged state by moving toward one side in a movable direction, and opening the lower portion of the concave part to be in the non-engaged state by moving toward the other side in the movable direction. The movable portion may have an abutting portion with which the shaft located below the concave part is capable of coming into contact from below, and the abutting portion may be formed on an inclined surface which is gradually inclined from the other side toward the one side in the movable direction as going from a lower side toward an upper side.

According to the above, at the time of attaching the toilet lid to the main body, the toilet lid is moved toward a lower side due to its own weight while the abutting portion is in contact with the shaft from an upper side, thus, the abutting portion (the movable portion) is moved toward the lower side along the shaft and is moved toward the other side in the movable direction due to the reaction force from the shaft and brought into the non-engaged state. The lower side of the concave part is opened when the movable portion is in a non-engaged state. Thus, when the toilet lid is moved toward the further lower side due to its own weight, the shaft is capable of being accommodated in the concave part.

In this way, the toilet lid is capable of being easily attached to the main body using the weight of the toilet lid.

A toilet seat device according to some embodiments of the present disclosure includes: a main body installed at an upper rear part of a toilet; a toilet seat attached to the main body; and a toilet lid configured to open and close an upper part of the toilet seat, wherein the toilet lid includes: a toilet lid main body configured to close the upper part of the toilet seat; and a shaft engagement part which is attached to an end part of the toilet lid main body in a width direction and is detachably attached to a shaft provided on the main body, the main body has a toilet lid support portion being in contact with an intermediate portion of the toilet lid in a width direction from a rear side when the toilet lid is in an open state, and the shaft engagement part is configured to be removed from the shaft when the toilet lid is deflected so that the intermediate portion of the toilet lid in the width direction comes into contact with the toilet lid support portion when the toilet lid is in the open state and an end part of the toilet lid in the width direction becomes located rear side than the intermediate portion in the width direction.

According to the above, when a user who is sitting on the toilet seat leans against the toilet lid in an open state, the toilet lid is brought into contact with the toilet lid support portion and is deflected so that the end portion side in the width direction is located rear side than the intermediate portion thereof (the portion thereof which is in contact with the toilet lid support portion) in the width direction. In the toilet seat device according to the present disclosure, when the toilet lid is deflected as described above, the shaft engagement part is removed from the shaft. Thus, the toilet lid is capable of being removed from the main body. In this way, in the toilet seat device according to the present disclosure, when a user leans against the toilet lid and a load is applied to the toilet lid, the toilet lid is capable of being prevented from becoming broken. Since the toilet lid is removed from the main body by deflecting the toilet lid, the toilet lid is capable of being configured to be removed from the main body when a user leans against the toilet lid regardless of a design and a material.

The toilet lid is deflected such that the end portion side thereof in the width direction becomes located rearward than the intermediate portion thereof in the width direction so that the shaft engagement part is removed from the shaft. Thus, for example, when cleaning such as wiping of the toilet lid along a surface thereof is performed, the toilet lid does not deflect as described above. Thus, there is no concern that the toilet lid may be removed from the main body.

In a toilet seat device according to some embodiments of the present disclosure, the shaft engagement part may be configured to be switchable between an engaged state in which the shaft engagement part is engaged with the shaft and a non-engaged state in which the engagement with the shaft is released, and may include a concave part opened downward and configured such that the shaft is capable of being put in and put out from a lower side, the concave part being configured to be capable of accommodating the shaft; and a movable portion configured to be movable, the movable portion closing a lower portion of the concave part to be in the engaged state by moving toward one side in a movable direction, and opening the lower portion of the concave part to be in the non-engaged state by moving toward the other side in the movable direction, wherein the movable portion may have a contact portion with which the shaft accommodated in the concave part is able to come into contact, and the shaft may be configured to be removed from the shaft when the toilet lid is deflected so that the intermediate portion of the toilet lid in the width direction comes into contact with the toilet lid support portion when the toilet lid is in the open state and an end part of the toilet lid in the width direction becomes located rear side than the intermediate portion in the width direction.

According to the above, in a state in which the toilet lid is opened, when the toilet lid is deflected so that the intermediate portion of the toilet lid in the width direction comes into contact with the toilet lid support portion and the end portion thereof in the width direction becomes located rear side than the intermediate portion thereof in the width direction, when the shaft comes into contact with a contact portion from one side in the movable direction, the movable portion is pushed toward the other side in the movable direction to be in a non-engaged state. Thus, since the concave part is opened, the shaft is capable of being removed from the concave part and the toilet lid is capable of being removed from the main body.

In a toilet seat device according to some embodiments of the present disclosure, the shaft engagement part may be arranged further outward in the width direction than the toilet lid support portion.

According to the above, it is possible to bend the toilet lid so that the portion of the toilet lid in which the shaft engagement part is provided is reliably located on the rear side thereof. Thus, when a user leans against the toilet lid and the toilet lid is deflected as described above, the toilet is capable of being configured to be easily removed from the main body.

An outer side of the toilet lid in the width direction may refer to an end portion side of the toilet lid with respect to a central portion thereof in the width direction.

According to a toilet seat device associated with the present disclosure, a toilet lid is capable of being easily attached to and detached from a main body installed at an upper rear part of a toilet.

According to a toilet seat device associated with the present disclosure, a toilet lid is capable of being prevented from becoming broken when a user leans against the toilet lid regardless of a design and a material.

DETAILED DESCRIPTION OF THE DISCLOSURE

A toilet seat device 1 according to some embodiments of the present disclosure will be described below with reference to FIGS. 1 to 23.

Figure 1:
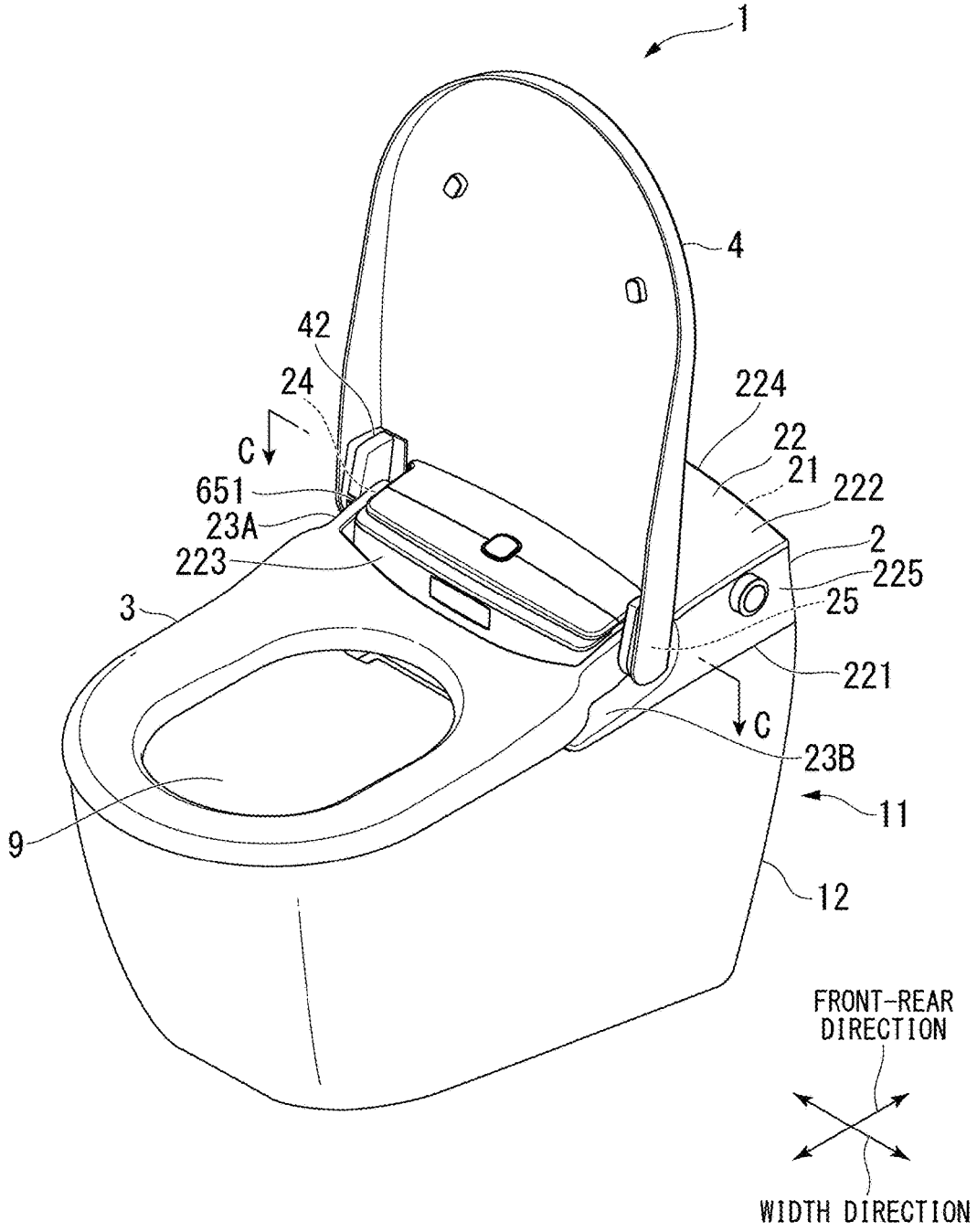
FIG. 1 is a perspective view illustrating an example of a toilet seat device according to some embodiments.

As illustrated in FIG. 1, the toilet seat device 1 according to some embodiments is installed above a toilet main body 12 of a toilet 11. The toilet seat device 1 includes a main body 2 installed on an upper rear part of the toilet main body 12, a toilet seat 3 rotatably attached to the main body 2, and a toilet lid 4 rotatably attached to the main body 2 and configured to open and close an upper part of the toilet seat 3.

Hereinafter, description will be provided with a side on which a user is present with respect to the toilet 11 being referred to as a "front side" in a forward-rearward direction, a side on which the toilet 11 is present with respect to the user being referred to as a "rear side" in the forward-rearward direction at the time of using the toilet 11. That is to say, the main body 2 side is referred to as the "rear side" in the forward-rearward direction and a toilet bowl 9 side of the toilet main body 12 is referred to as the "front side" in the forward-rearward direction. Furthermore, description will be provided with a horizontal direction orthogonal to the forward-rearward direction being referred to as a "width direction". In the toilet seat device 1, sides on which both end portions thereof are located in the width direction with respect to a center thereof in the width direction are set as "outer sides" in the width direction and a portion on which the center thereof in the width direction is present with respect to both end portions thereof in the width direction is set as an "inner side" in the width direction.

A state in which the toilet lid 4 is standing upright and away from the toilet seat 3 is assumed to be a state in which the toilet lid 4 is opened and a state in which the toilet lid 4 is laid down and the toilet lid 4 and the toilet seat 3 overlap is assumed to be a state in which the toilet lid 4 is closed.

As illustrated in FIGS. 1 to 4, the main body 2 includes a functional portion 21 having various functions and a case 22 configured to accommodate the functional portion 21.

The functional portion 21 refers to a toilet seat-rotating unit configured to rotate a toilet seat, a toilet lid-rotating unit configured to rotate a toilet lid, various functional devices, various functional components, a control unit, a power supply unit, and the like. Examples of the various functional devices include a private part cleaning device, a deodorizing device, and the like. The control unit controls the various functional devices and the various functional components. The power supply unit refers to a power supply unit and the like configured to supply electric power to the various functional devices and the various functional components.

The case 22 covers the periphery of the functional portion 21, that is, both sides of the functional portion 21 in an upward-downward direction, both sides thereof in the width direction, and both sides thereof in the forward-rearward direction.

The case 22 includes a case lower plate part 221, a case upper plate part 222, a case front plate part 223, a case rear plate part 224 (refer to FIG. 1), and a pair of case side plate parts 225. The case lower plate part 221 is placed on an upper part of the toilet main body 12 and the functional portion 21 is placed on an upper part of the case lower plate part 221. The case upper plate part 222 is arranged on an upper part of the functional portion 21. The case front plate part 223 is arranged in front of the functional portion 21. The case rear plate part 224 is arranged behind the functional portion 21. The pair of case side plate parts 225 are constituted of a first case side plate part 2251 and a second case side plate part 2252 which are arranged on both sides of the functional portion 21 in the width direction.

In the following description, in a state in which the toilet seat device 1 is installed on the toilet main body 12, an end portion thereof on one side in the width direction and on the first case side plate part 2251 side is referred to as a "first end" in the width direction and an end portion thereof on the other side in the width direction and on the second case side plate part 2252 side is referred to as a "second end" in the width direction.

Case concave portions 23A and 23B are formed on both sides on a front side portion of the case 22 in the width direction. The case concave portions 23A and 23B are formed to be concave such that the case concave portions 23A and 23B are close to each other in the width direction.

A first shaft 24 protruding outward in the width direction from the case 22 is arranged in a first case concave portion 23A of the two case concave portions 23A and 23B on a first end side (one side) in the width direction. A second shaft 25 protruding outward in the width direction from the case 22 is arranged in a second case concave portion 23B on a second end side (the other side) in the width direction. The first shaft 24 and the second shaft 25 protrude in different directions in the width direction.

The first shaft 24 and the second shaft 25 are configured such that the toilet seat 3 and the toilet lid 4 are attached. The toilet seat 3 and the toilet lid 4 (refer to FIG. 1) are configured to rotate by rotating the first shaft 24 and the second shaft 25.

Figure 2:
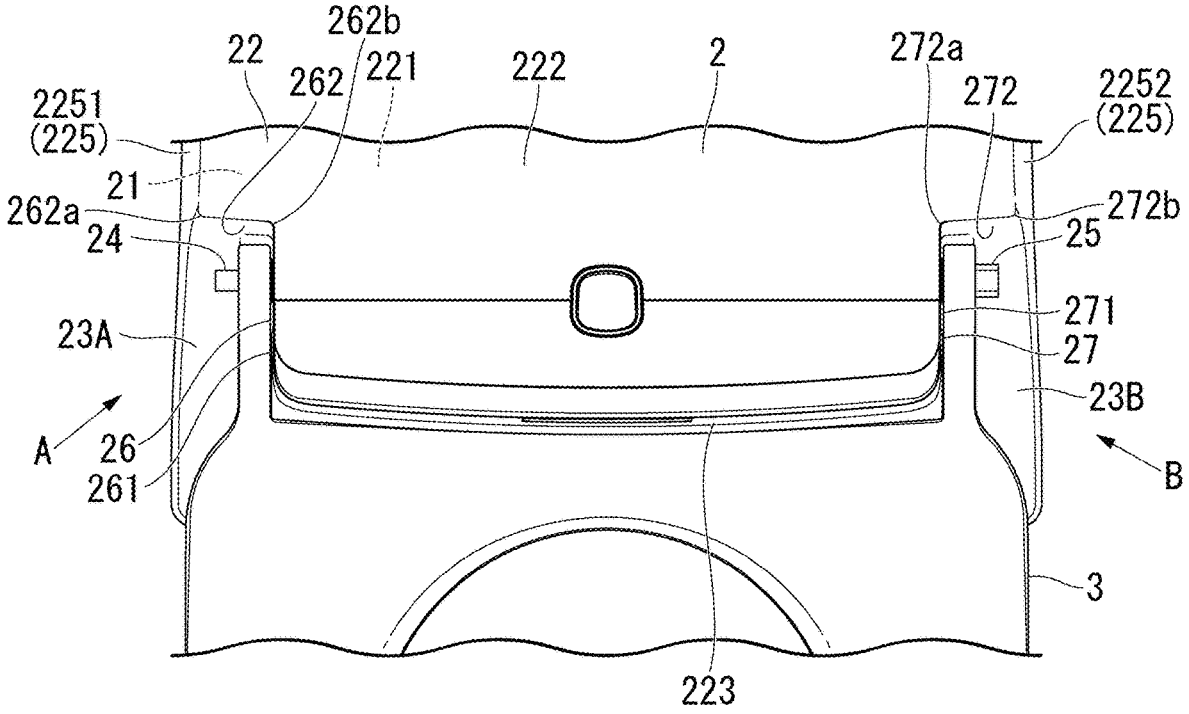
FIG. 2 is a plan view illustrating a part of the toilet seat device in a state in which a toilet lid is removed according to some embodiments.
Figure 3:
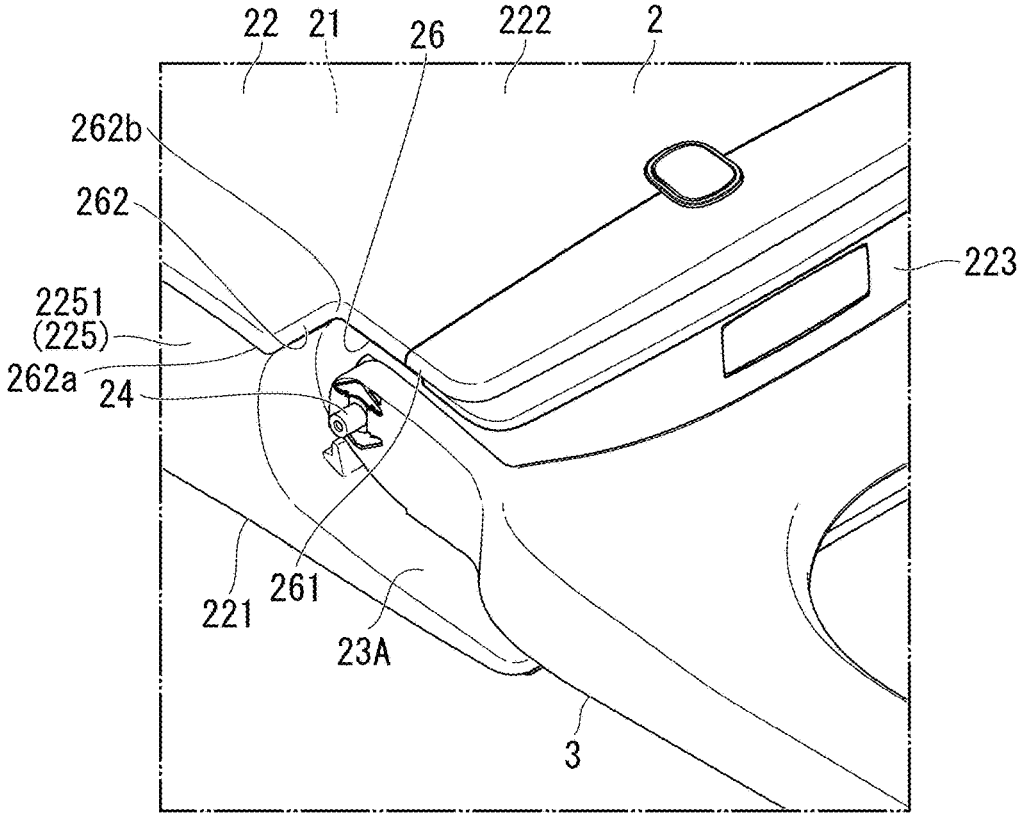
FIG. 3 is a perspective view when viewed from an A direction shown in FIG. 2 according to some embodiments.
Figure 4:
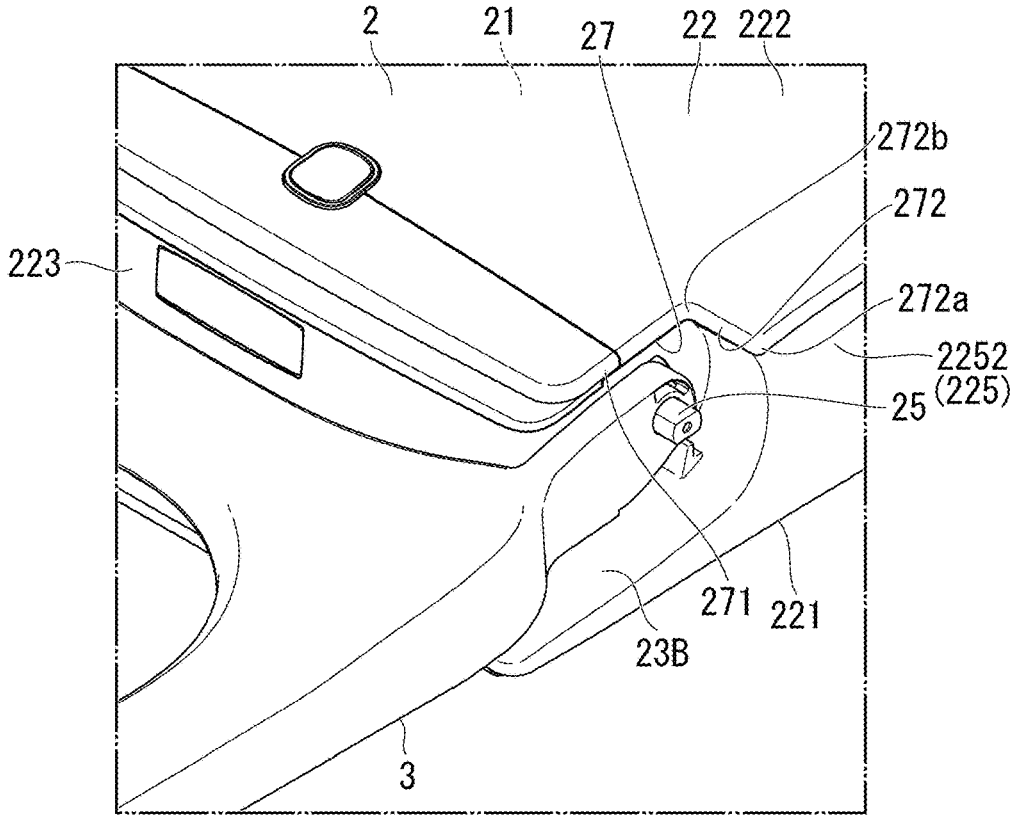
FIG. 4 is a perspective view when viewed from a B direction shown in FIG. 2 according to some embodiments.

As illustrated in FIGS. 2 to 4, the case upper plate part 222 has a first notch portion 26 formed at an end portion thereof on a front side portion on a first end side in the width direction and a second notch portion 27 formed at an end portion thereof on the front side portion on a second end side in the width direction.

The first notch portion 26 has a shape corresponding to the first case concave portion 23A and is opened toward the front side and one side in the width direction (outward in the width direction). The second notch portion 27 has a shape corresponding to the second case concave portion 23B and is opened toward the front side and the other side in the width direction (outward in the width direction).

A first case edge portion 261 and a second case edge part 262 which are edge portions forming the first notch portion 26 of the case upper plate part 222. The first case edge portion 261 extends in the forward-rearward direction when viewed from above. The second case edge part 262 is connected to a rear end of the first case edge portion 261. An end portion of the second case edge part 262 located on the outer side in the width direction (one side in the width direction) and on the rear side is referred to as an "outer end portion 262*a*". An end portion of the second case edge part 262 located on the inner side in the width direction (the other side in the width direction) and on the front side is referred to as an "inner end part 262*b*". When viewed from above, the second case edge part 262 extends obliquely and gradually forward from the outer end portion 262*a* to the inner end part 262*b*. The inner end part 262*b* is an example of the toilet lid support portion.

A third case edge portion 271 and a fourth case edge portion 272 which are edge portions forming the second notch portion 27 of the case upper plate part 222. The third case edge portion 271 extends in the forward-rearward direction when viewed from above. The fourth case edge portion 272 is connected to a rear end of the third case edge portion 271. An end portion of the fourth case edge portion 272 located on the outer side in the width direction (the other side in the width direction) and on the rear side is referred to as an "outer end portion 272*a*". An end portion thereof located on the inner side in the width direction (one side in the width direction) and on the front side is referred to as an "inner end part 272*b*". When viewed from above, the fourth case edge portion 272 extends obliquely and gradually forward from the outer end portion 272*a* to the inner end part 272*b*.

Each of the pair of case side plate parts 225 has a case concave side plate part 225*a* bent to correspond to the first case concave portion 23A and the second case concave portion 23B in the front side portion thereof. The case concave side plate part 225*a* corresponding to the first case concave portion 23A extends downward from the first case edge portion 261 and the second case edge part 262 of the case upper plate part 222. The case concave side plate part 225*a* corresponding to the second case concave portion 23B extends downward from the third case edge portion 271 and the fourth case edge portion 272 of the case upper plate part 222.

Figure 5:
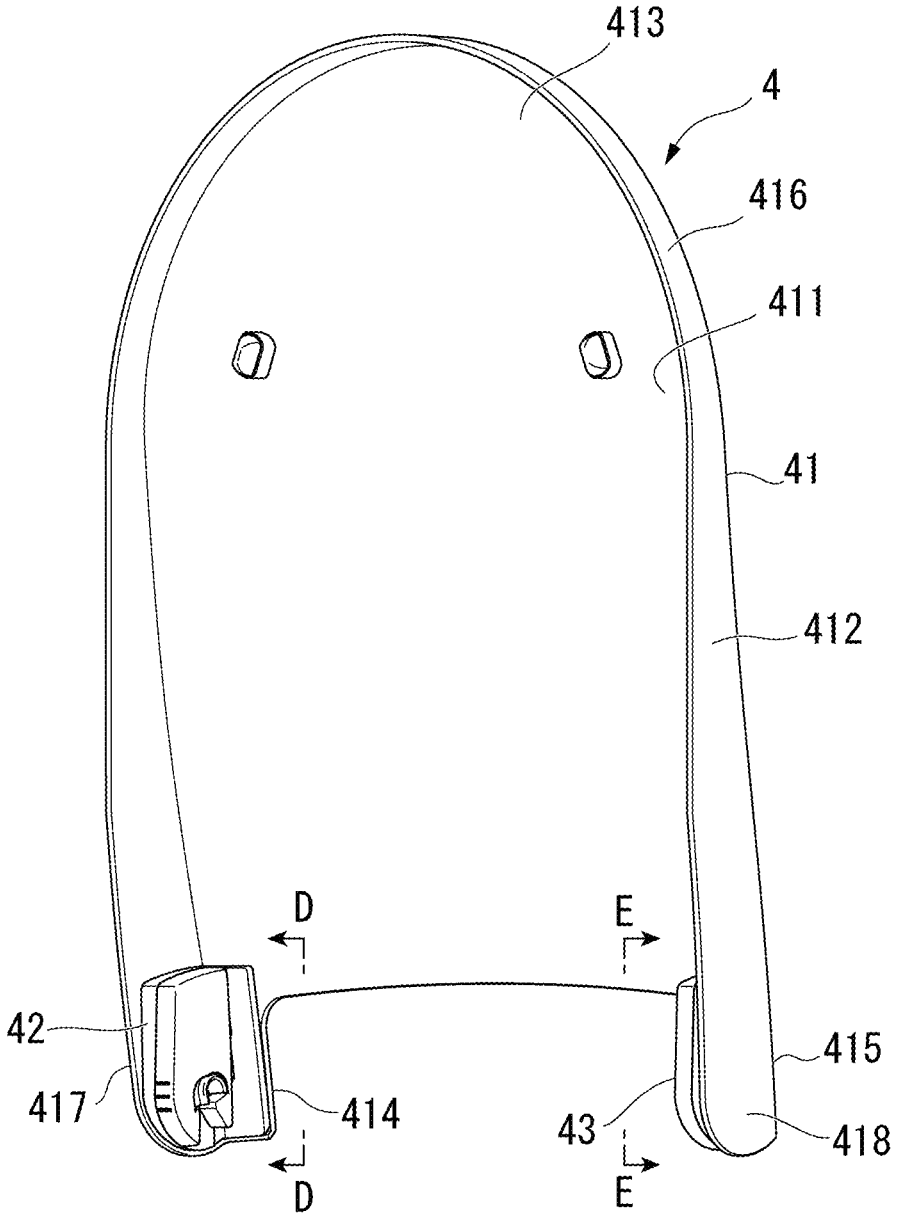
FIG. 5 is a perspective view of the toilet lid according to some embodiments.

As illustrated in FIG. 5, the toilet lid 4 includes a toilet lid main body 41 configured to open and close the upper part of the toilet seat 3, a first shaft engagement part 42, and a second shaft engagement part 43. The first shaft engagement part 42 is attached to the toilet lid main body 41 and engaged with the first shaft 24 (refer to FIG. 2). The second shaft engagement part 43 is attached to the toilet lid main body 41 and engaged with the second shaft 25 (refer to FIG. 2). The toilet lid 4 is configured to be locked to the main body 2 (refer to FIG. 2) when the first shaft 24 is engaged with the first shaft engagement part 42 and the second shaft 25 is engaged with the second shaft engagement part 43.

The toilet lid main body 41 includes a toilet lid upper plate 411 and a toilet lid side plate 412. The toilet lid upper plate 411 covers the upper part of the toilet seat 3 (refer to FIG. 1) in a state in which the toilet lid 4 is closed. The toilet lid side plate 412 covers a lateral side in the width direction and the front side of the toilet seat 3 in a state in which the toilet lid 4 is closed.

The toilet lid upper plate 411 includes an open-close upper plate part 413, a first attachment upper plate part 414, and a second attachment upper plate part 415. The open-close upper plate part 413 covers an upper part of a seating portion 31 (a portion on which a user sits) of the toilet seat 3 in a state in which the toilet lid 4 is closed. The first attachment upper plate part 414 extends rearward from the vicinity of an end portion of the open-close upper plate part 413 on a first end side thereof in the width direction and has the first shaft engagement part 42 attached thereto. The second attachment upper plate part 415 extends rearward from the vicinity of an end portion of the open-close upper plate part 413 on a second end side thereof in the width direction and has the second shaft engagement part 43 attached thereto.

The open-close upper plate part 413 is arranged in front of the main body 2 in a state in which the toilet lid 4 is closed and arranged above the main body 2 in a state in which the toilet lid 4 is opened.

Figure 6:
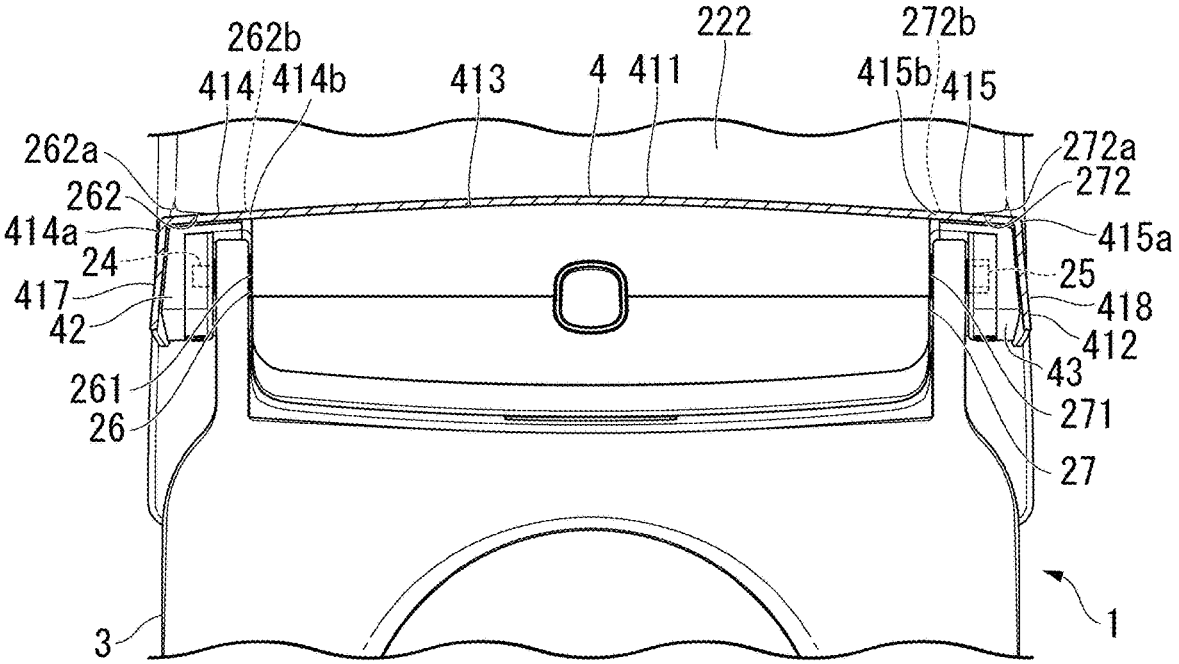
FIG. 6 is a cross-sectional view in a horizontal direction taken along line C-C of FIG. 1 according to some embodiments.

As illustrated in FIG. 6, the open-close upper plate part 413 is curved so that a central portion thereof in the width direction is located rear side than both end portions thereof in the width direction in a state in which the toilet lid 4 is opened.

The first attachment upper plate part 414 is arranged on an upper portion of the first case concave portion 23A of the main body 2 in a state in which the toilet lid 4 is closed and arranged inside the first case concave portion 23A in a state in which the toilet lid 4 is opened. The first attachment upper plate part 414 in a state in which the toilet lid 4 is opened is gradually inclined to go toward the rear side from the first end side toward the second end side in the width direction and arranged on the front side of the second case edge part 262 of the case upper plate part 222.

An end portion of the first attachment upper plate part 414 on the first end side in the width direction is referred to as an "outer end portion 414*a*" and an end portion thereof located on the second end side in the width direction is referred to as an "inner end part 414*b*". When viewed in plan view, the outer end portion 414*a* of the first attachment upper plate part 414 is disposed at a position at which it protrudes further outward in the width direction than the outer end portion 262*a* of the second case edge part 262. When viewed in plan view, the inner end part 414*b* is arranged on the front side of the inner end part 262*b* of the second case edge part 262.

In a state in which the toilet lid 4 is opened, the inner end part 414*b* is in contact with the inner end part 262*b* of the second case edge part 262, the outer end portion 414*a* side is further away from the second case edge part 262 than the inner end part 414*b*, and a gap is formed between the first attachment upper plate part 414 and the second case edge part 262.

The gap between the first attachment upper plate part 414 and the second case edge part 262 in a state in which the toilet lid 4 is opened is designed to gradually enlarge from the inner end part 414*b* side toward the outer end portion 414*a* side.

The second attachment upper plate part 415 is arranged on an upper portion of the second case concave portion 23B of the main body 2 in a state in which the toilet lid 4 is closed and arranged inside the second case concave portion 23B in a state in which the toilet lid 4 is opened. The second attachment upper plate part 415 in a state in which the toilet lid 4 is opened is gradually inclined to go toward the rear side from the second end side toward the first end side in the width direction and arranged on the front side of the fourth case edge portion 272 of the case upper plate part 222.

An end portion of the second attachment upper plate part 415 on the second end side in the width direction is referred to as an "outer end portion 415*a*" and an end portion thereof on the first end side in the width direction is referred to as an "inner end part 415*b*". When viewed in plan view, the outer end portion 415*a* of the second attachment upper plate part 415 is arranged at a position further protruding outward in the width direction than the outer end portion 272*a* of the fourth case edge portion 272 and the inner end part 415*b* of the second attachment upper plate part 415 is arranged in the vicinity of the inner end part 272*b* of the fourth case edge portion 272.

In a state in which the toilet lid 4 is opened, in the second attachment upper plate part 415, the inner end part 415*b* is in contact with the inner end part 272*b* of the fourth case edge portion 272, the outer end portion 415*a* side is further away from the fourth case edge portion 272 than the inner end part 415*b*, and a gap is formed between the second attachment upper plate part 415 and the fourth case edge portion 272.

The gap between the second attachment upper plate part 415 and the fourth case edge portion 272 in a state in which the toilet lid 4 is opened is designed to gradually increase from the inner end part 415*b* side toward the outer end portion 415*a* side.

As illustrated in FIG. 5, the toilet lid side plate 412 includes an open-close side plate part 416, a first attachment side plate part 417, and a second attachment side plate part 418. In a state in which the toilet lid 4 is closed, the open-close side plate part 416 extends downward from a front edge portion and a side edge portion of the open-close upper plate part 413. In a state in which the toilet lid 4 is closed, the first attachment side plate part 417 extends downward from an edge portion of the first attachment upper plate part 414 on the first end side in the width direction. In a state in which the toilet lid 4 is closed, the second attachment side plate part 418 extends downward from an edge portion of the second attachment upper plate part 415 on the second end side in the width direction.

Figure 7:
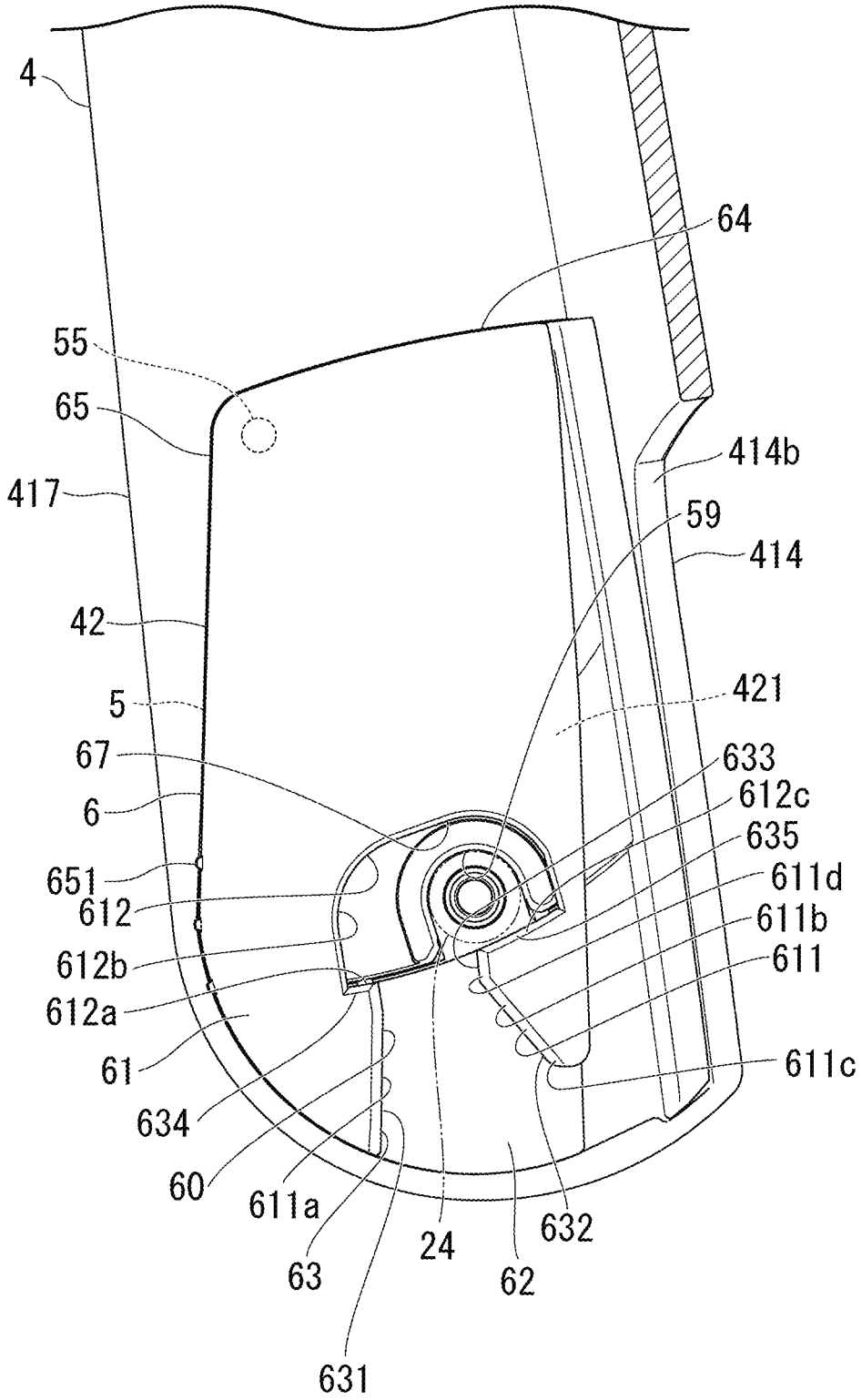
FIG. 7 is a cross-sectional view taken along line D-D of FIG. 5 according to some embodiments.
Figure 8:
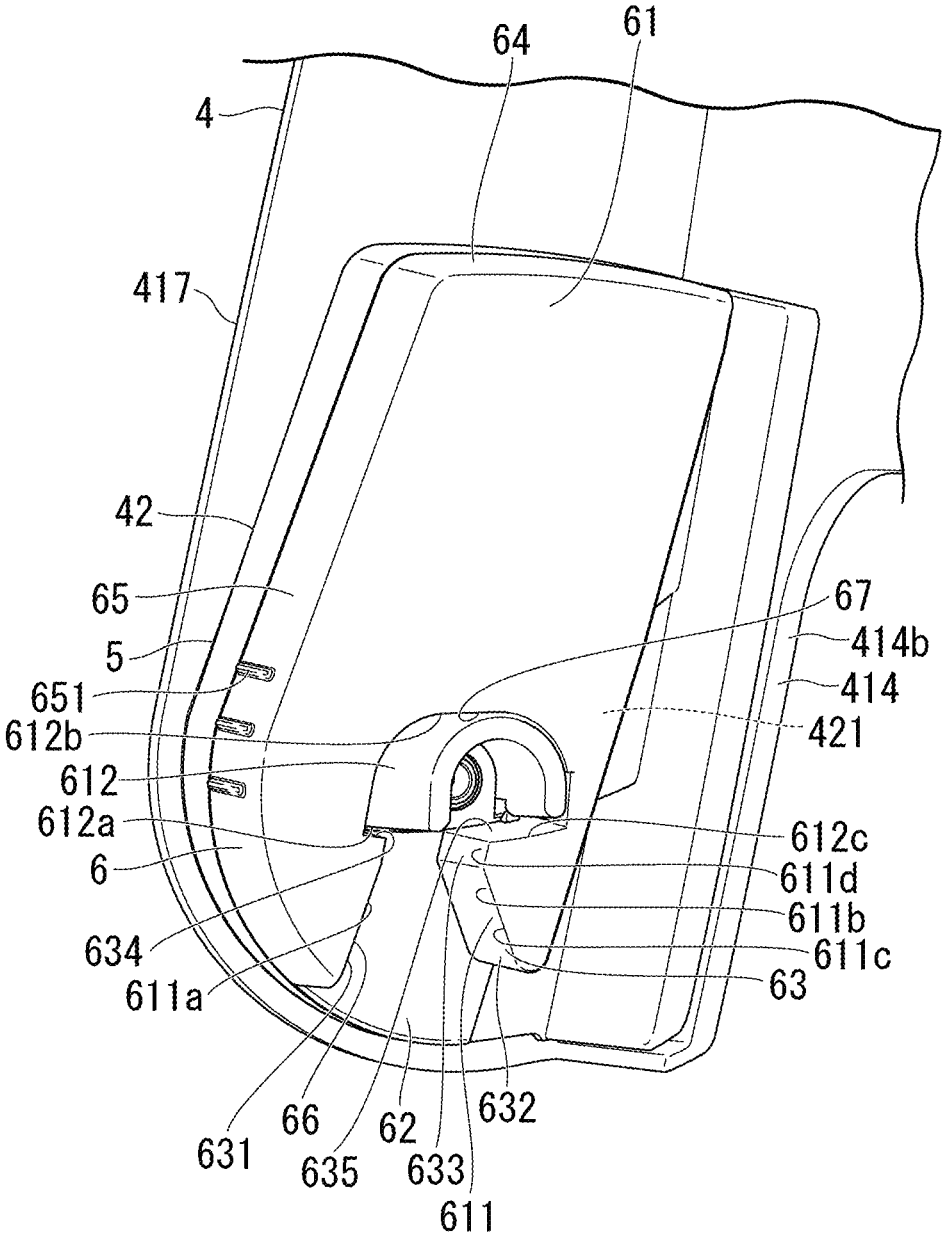
FIG. 8 is a perspective view of a first shaft engagement part according to some embodiments.

As illustrated in FIGS. 7 and 8, the first shaft engagement part 42 is arranged inside a corner portion formed by the first attachment upper plate part 414 and the first attachment side plate part 417. The first shaft engagement part 42 includes a fixed portion 5, a movable portion 6, and a spring (a biasing portion) 421. The fixed portion 5 is fixed to the first attachment side plate part 417. The movable portion 6 is arranged so that the movable portion 6 and an inner portion of the fixed portion 5 in the width direction overlap and rotatably provided with respect to the fixed portion 5. The spring 421 biases the movable portion 6 in a predetermined direction.

In the following description of the first shaft engagement part 42, a description will be provided in a state in the toilet lid 4 is opened.

Figure 9:
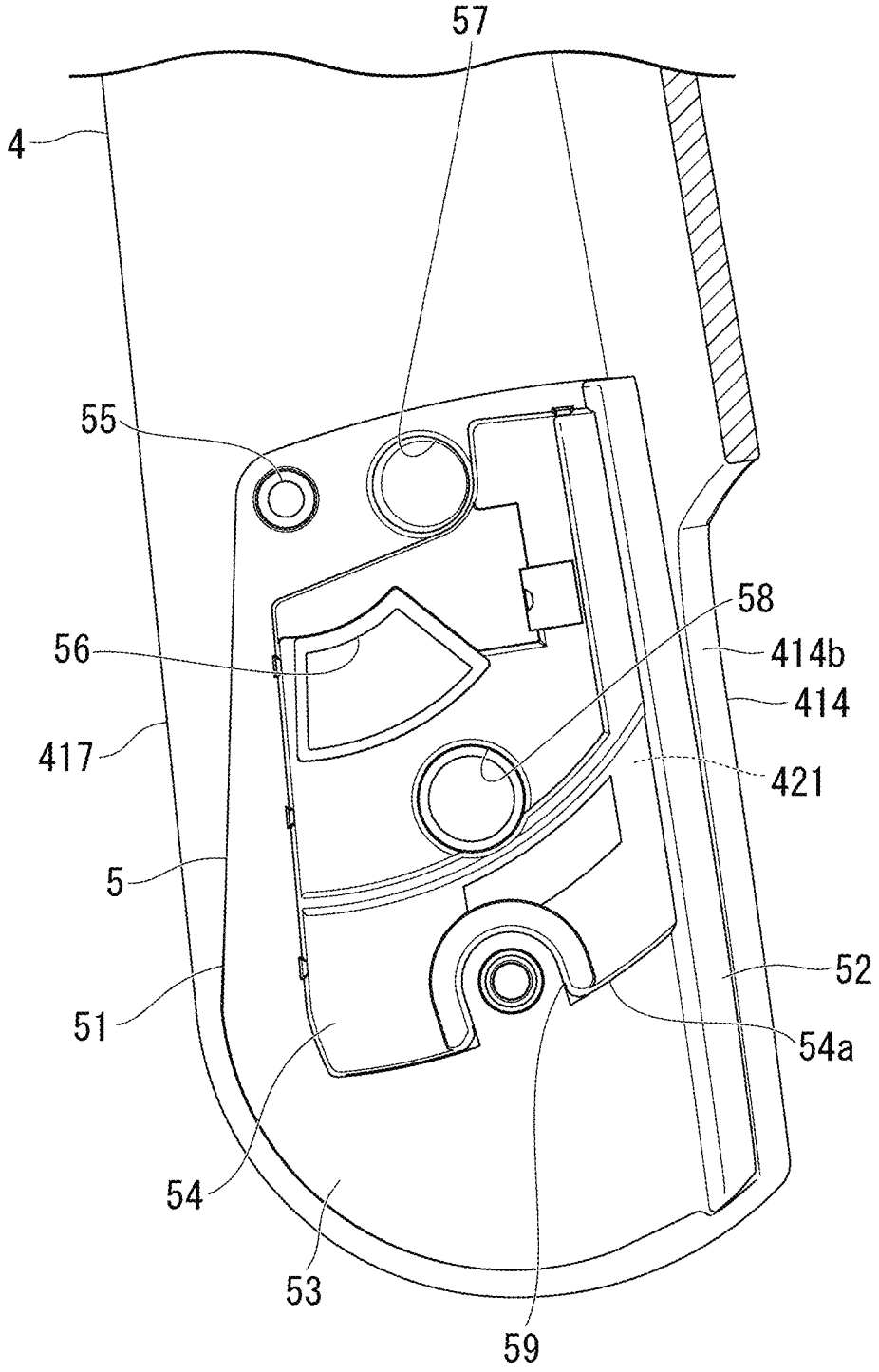
FIG. 9 is a diagram of a movable portion removed in the state of FIG. 7 according to some embodiments.
Figure 10:
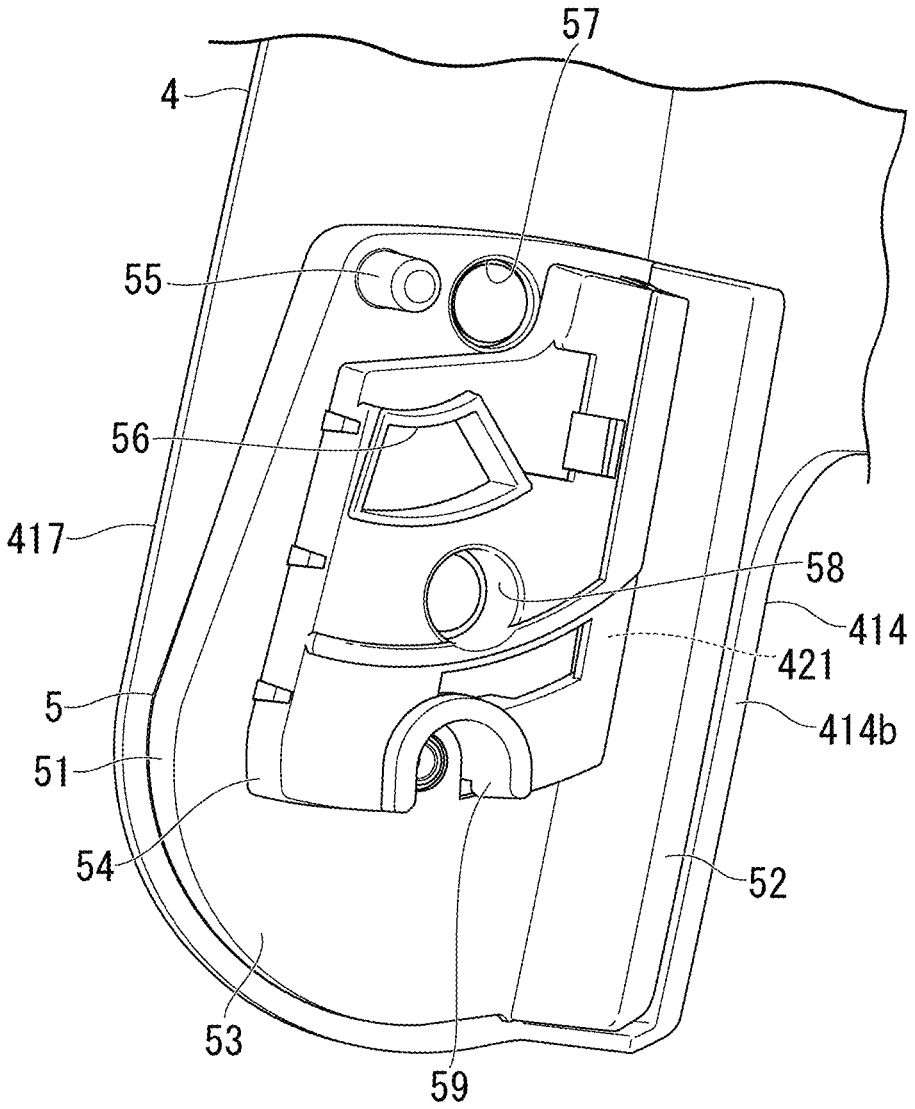
FIG. 10 is a diagram of the movable portion removed in the state of FIG. 8 according to some embodiments.
Figure 11:
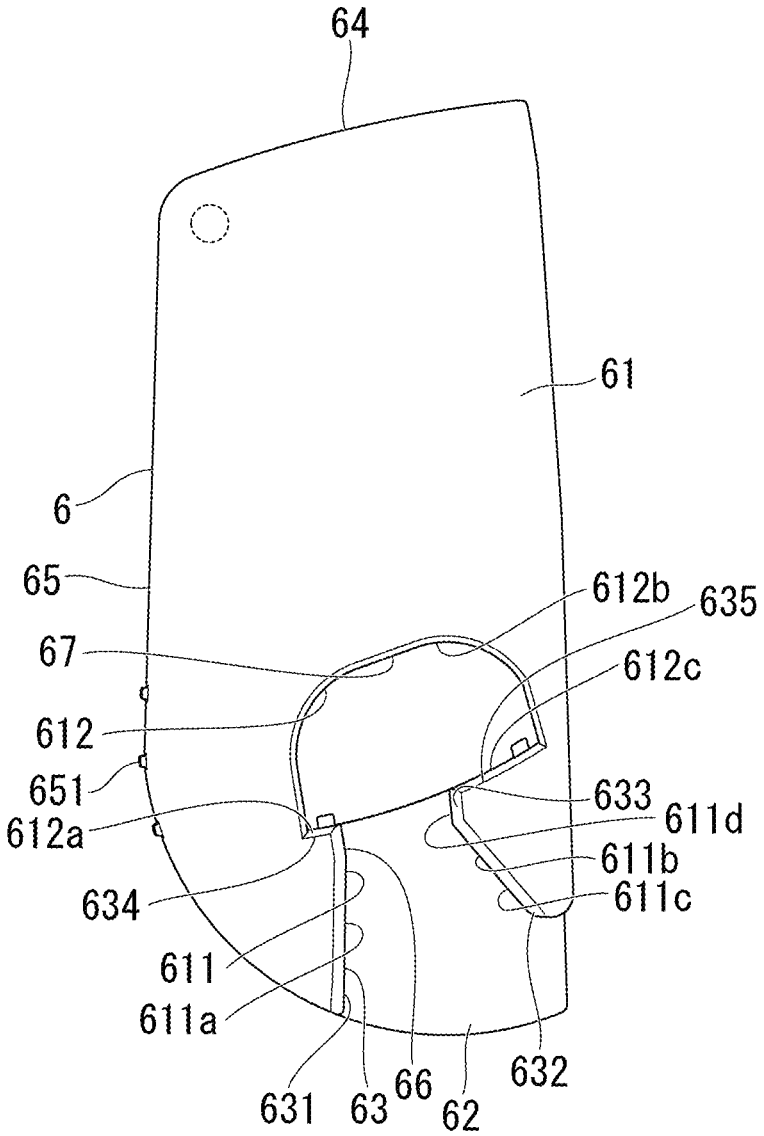
FIG. 11 is a diagram of the movable portion when viewed from a width direction according to some embodiments.

As illustrated in FIGS. 9 and 10, the fixed portion 5 includes a first fixed portion 51 and a flat plate-shaped second fixed portion 52. The first fixed portion 51 is arranged along the first attachment side plate part 417. The second fixed portion 52 is continuous with the edge portion of the first fixed portion 51 on the rear side thereof and arranged along the first attachment upper plate part 414.

The first fixed portion 51 is a member with a predetermined thickness and arranged in a direction in which a thickness direction is the width direction. The first fixed portion 51 includes a circumferential edge part 53 and an inner portion 54. When viewed in the width direction, the inner portion 54 is located inside the circumferential edge part 53, protrudes inward in the width direction from the circumferential edge part 53, and is formed to be thicker than that of the circumferential edge part 53.

Hereinafter, the circumferential edge part 53 of the first fixed portion 51 when viewed in the width direction is referred to as a "thin plate part 53" and the inner portion 54 thereof is referred to as a "thick plate part 54". When the fixed portion 5 is viewed from the width direction, the thin plate part 53 is arranged throughout the entire circumference of the thick plate part 54.

The first fixed portion 51 includes a rotating shaft 55, a guide hole 56, a first fixing hole 57, a second fixing hole 58, and a first shaft accommodation concave part (a concave part) 59. The rotating shaft 55 rotatably supports the movable portion 6. The guide hole 56 guides the rotation of the movable portion 6. A fixing tool configured to fix the first fixed portion 51 to the first attachment side plate part 417 is inserted through the first fixing hole 57 and the second fixing hole 58. The first shaft accommodation concave part 59 is formed to be able to have the first shaft 24 (refer to FIG. 3) accommodated therein.

The rotating shaft 55 is located in an upper front portion of the first fixed portion 51 and protrudes inward in the width direction from the thin plate part 53. A distal end portion of the rotating shaft 55 protrudes so that an inner surface and a position of the thick plate part 54 in the width direction thereof are substantially the same.

The guide hole 56 is located below the rotating shaft 55 and formed in the thick plate part 54. The guide hole 56 passes through the thick plate part 54 in the width direction. The guide hole 56 is formed in a circular arc shape in which the guide hole 56 is coaxial with the rotating shaft 55.

The first fixing hole 57 is located above the guide hole 56 and formed in the thin plate part 53. The first fixing hole 57 passes through the thin plate part 53 in the width direction.

The second fixing hole 58 is located below the guide hole 56 and formed in the thick plate part 54. The second fixing hole 58 passes through the thick plate part 54 in the width direction.

A hole portion into which a fixing tool such as a screw inserted through the first fixing hole 57 and the second fixing hole 58 is inserted is formed in the first attachment side plate part 417. The first fixed portion 51 is fixed to the first attachment side plate part 417 using a fixing tool such as a screw inserted through the first fixing hole 57 and the second fixing hole 58.

The first shaft accommodation concave part 59 is located below the second fixing hole 58 and formed at a lower edge portion 54*a* of the thick plate part 54. The first shaft accommodation concave part 59 is opened toward the lower side and the inner side in the width direction. The first shaft accommodation concave part 59 is formed in a semicircular shape in which an upper portion thereof is curved upward when viewed from the width direction. The first shaft accommodation concave part 59 is configured such that a tip end portion of the first shaft 24 is capable of moving into and outside of the first shaft accommodation concave part 59 from below and the first shaft 24 is capable of being accommodated therein. A dimension of the first shaft accommodation concave part 59 in the upward-downward direction is set to be substantially the same as an outer diameter of the first shaft 24.

The first shaft accommodation concave part 59 is arranged below and rear side than the rotating shaft 55.

As illustrated in FIGS. 7, 8, 11, and 12, the movable portion 6 includes a first movable plate part 61, second movable plate part 62, a connection plate 63, a movable upper plate part 64, and a movable side plate part 65. The first movable plate part 61 and the second movable plate part 62 are formed in a plate shape in which plate surfaces thereof face in the width direction and the second movable plate part 62 is arranged closer to one side (the outer side) in the width direction than the first movable plate part 61. The connection plate 63 connects the first movable plate part 61 to the second movable plate part 62. The movable upper plate part 64 extends outward in the width direction from an upper edge portion of the first movable plate part 61. The movable side plate part 65 protrudes outward in the width direction from a front edge portion of the first movable plate part 61. A front edge portion of the movable upper plate part 64 is connected to an upper edge portion of the movable side plate part 65.

The first movable plate part 61 is formed in a shape in which a plate surface thereof is long further in the upward-downward direction than in the forward-rearward direction. A first movable plate groove portion 611 extending upward from a lower edge portion of the first movable plate part 61 and a first movable plate concave portion 612 formed continuously above the first movable plate groove portion 611 and opened downward are formed in the first movable plate part 61. An inside of the first movable plate groove portion 611 is connected to an inside of the first movable plate concave portion 612 and both of the first movable plate groove portion 611 and the first movable plate concave portion 612 are formed on a lower portion side of the first movable plate part 61.

An edge portion of the first movable plate groove portion 611 on the front side (hereinafter referred to as a "front edge portion 611*a*") extends upward from the lower edge portion of the first movable plate part 61. An edge portion of the first movable plate groove portion 611 on the rear side (hereinafter referred to as a "rear edge portion 611*b*") includes a lower rear edge portion 611*c* and an upper rear edge portion 611*d*. The lower rear edge portion 611*c* extends from the lower edge portion of the first movable plate part 61 toward the upper side in an oblique direction in which the lower rear edge portion 611*c* is gradually inclined toward the front side. The upper rear edge portion 611*d* extends upward from an upper end portion of the lower rear edge portion 611*c*.

The first movable plate concave portion 612 is larger in the forward-rearward direction than a groove width (a dimension thereof in the forward-rearward direction) of the first movable plate groove portion 611, protrudes further forward than an upper end portion of the front edge portion 611*a* of the first movable plate groove portion 611, and is arranged to protrude further rearward than an upper end portion of the rear edge portion 611*b* (the upper rear edge portion 611*d*) of the first movable plate groove portion 611.

An edge portion forming the first movable plate concave portion 612 has first to third edge portions 612*a*, 612*b*, and 612*c*. The first edge portion 612*a* extends in an oblique direction in which the first edge portion 612*a* is gradually inclined to go downward from the upper end portion of the front edge portion 611*a* of the first movable plate groove portion 611 toward the front side. The second edge portion 612*b* has a U shape, extends upward from an end portion of the first edge portion 612*a* on the front side, extends rearward, and then extends downward. The third edge portion 612*c* extends such that the third edge portion 612*c* is gradually inclined to go downward from a lower end portion of the second edge portion 612*b* on the rear side toward the front side and is continuous with an upper end portion of the rear edge portion 611*b* of the first movable plate groove portion 611.

The third edge portion 612*c* is formed longer than the first edge portion 612*a* in the forward-rearward direction.

The second movable plate part 62 is arranged at a position in which the second movable plate part 62 and the inside of the first movable plate groove portion 611 of the first movable plate part 61 in the width direction overlap. An upper edge portion of the second movable plate part 62 is arranged at the same height as an upper edge portion of the first movable plate groove portion 611.

The connection plate 63 includes first to fifth connection plates 631, 632, 633, 634, and 635. The first connection plate 631 extends from the front edge portion 611*a* of the first movable plate groove portion 611 to the second movable plate part 62 in the width direction. The second connection plate (an abutting portion) 632 extends from the lower rear edge portion 611*c* of the first movable plate groove portion 611 of the first movable plate part 61 to the second movable plate part 62 in the width direction. The third connection plate 633 extends from the upper rear edge portion 611*d* of the first movable plate groove portion 611 of the first movable plate part 61 to the second movable plate part 62 in the width direction. The fourth connection plate 634 extends from the first edge portion 612*a* of the first movable plate concave portion 612 of the first movable plate part 61 to the second movable plate part 62 in the width direction. The fifth connection plate 635 extends from the third edge portion 612*c* of the first movable plate concave portion 612 to the second movable plate part 62 in the width direction.

The first connection plate 631 and the fourth connection plate 634 are continuously provided. The second connection plate 632, the third connection plate 633, and the fifth connection plate 635 are continuously provided.

The first connection plate 631 is formed in a flat plate shape in which a plate surface thereof faces in the forward-rearward direction and a surface thereof on the rear side faces the first movable plate groove portion 611.

The second connection plate 632 is formed such that a plate surface thereof is an inclined surface which is gradually inclined toward the front side from the lower side toward the upper side and a surface thereof which faces the front side and the lower side faces the first movable plate groove portion 611.

The third connection plate 633 is formed in a flat plate shape in which a plate surface thereof faces in the forward-rearward direction and a surface thereof on the front side faces the first movable plate groove portion 611.

A space in the movable portion 6 extending between the first connection plate 631, the second connection plate 632, and the third connection plate 633 in the upward-downward direction is referred to as a "movable groove portion 66".

The fourth connection plate 634 is formed such that a plate surface thereof is an inclined surface which is gradually inclined to go downward from the rear side toward the front side and an upper surface thereof faces the first movable plate concave portion 612.

The fifth connection plate 635 is formed such that a plate surface thereof is an inclined surface which is gradually inclined to go downward from the rear side toward the front side and an upper surface thereof faces the first movable plate concave portion 612.

A space in the movable portion 6 located above the movable groove portion 66, the fourth connection plate 634, and the fifth connection plate 635 and inside the first movable plate concave portion 612 when viewed from the width direction is referred to as a "movable concave portion 67".

Figure 12:
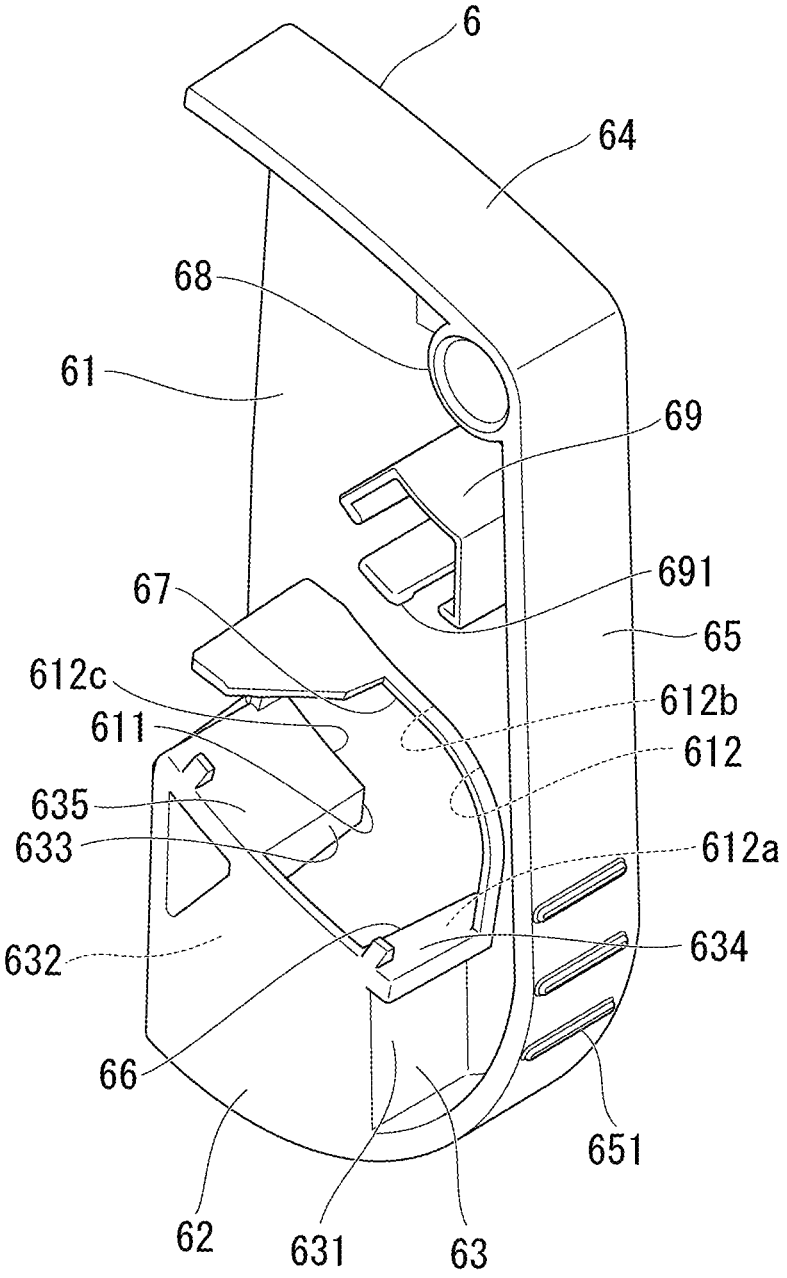
FIG. 12 is a perspective view of the movable portion when viewed from an outer side in the width direction according to some embodiments.

As illustrated in FIG. 12, the movable portion 6 includes a shaft insertion tubular part 68 and a guide part 69. The shaft insertion tubular part 68 is a tubular part which protrudes from a surface of the first movable plate part 61 on the first end side in the width direction and into which the rotating shaft 55 of the fixed portion 5 is inserted. The guide part 69 protrudes from the surface of the first movable plate part 61 on the first end side in the width direction and inserted into the guide hole 56 of the fixed portion 5.

The shaft insertion tubular part 68 is formed in a shape in which the rotating shaft 55 inserted coaxially is rotatable around an axis.

The guide part 69 is formed smaller than the guide hole 56 and is formed in a shape in which the guide part 69 is movable inside the guide hole 56 when the movable portion 6 rotates around the axis of the rotating shaft 55. A claw portion 691 which is engaged with the edge portion of the guide hole 56 is formed in the guide part 69 when the guide part 69 is inserted into the guide hole 56. The claw portion 691 is configured to elastic deform to be engaged with the edge portion of the guide hole 56 through elastic deformation.

Such a movable portion 6 and the fixed portion 5 overlap from the inner side in the width direction, the rotating shaft 55 of the fixed portion 5 is inserted into the shaft insertion tubular part 68, and the guide part 69 is inserted into the guide hole 56 of the fixed portion 5 so that the movable portion 6 is attached to the fixed portion 5. The movable concave portion 67 of the movable portion 6 is arranged at a position in which the movable concave portion 67 of the movable portion 6 and the first shaft accommodation concave part 59 of the fixed portion 5 overlap in the width direction. The movable concave portion 67 is formed to be larger than the first shaft accommodation concave part 59 of the fixed portion 5 in the forward-rearward direction.

The movable portion 6 attached to the fixed portion 5 is configured to be rotatable about the rotating shaft 55 with respect to the fixed portion 5.

As illustrated in FIG. 7, the rotating shaft 55 is arranged above the front side of the movable portion 6. For this reason, the movable portion 6 is configured to rotate around the rotating shaft 55 by a predetermined angle so that a portion thereof below the rotating shaft 55 (the shaft insertion tubular part 68) is moved in the forward-rearward direction.

As described above, the movable concave portion 67 is formed to be larger than the first shaft accommodation concave part 59 in the forward-rearward direction. Thus, the movable concave portion 67 is configured such that the movable concave portion 67 and the first shaft accommodation concave part 59 of the fixed portion 5 always, in some embodiments, overlap when the movable portion 6 rotates. For this reason, the first shaft accommodation concave part 59 is configured not to be closed when the movable portion 6 rotates.

The spring 421 is configured to bias the movable portion 6 so that a portion thereof below the rotating shaft 55 (the shaft insertion tubular part 68) is directed toward the front side. For example, a leaf spring and the like supported by the fixed portion 5 is used for the spring 421.

The movable portion 6 is configured to be located on the front side when a force other than a biasing force of the spring 421 acts in the forward-rearward direction and to rotate to be located on the rear side when a force equal to or larger than the biasing force of the spring 421 acts in the forward-rearward direction.

In some embodiments, a pressing part 651 configured to press the movable portion 6 by a user is provided on the movable side plate part 65 of the movable portion 6. When the user pushes the pressing part 651 from the front side toward the rear side, the movable portion 6 is configured to rotate and move toward the rear side. For example, an embodiment in which a rib and the like may be provided on the pressing part 651 and the user easily recognizes a position of the pressing part 651 or easily pushes the pressing part 651 may be provided.

As illustrated in FIG. 7, in a state in which the movable portion 6 is located on the front side in a range in which the movable portion 6 is rotatable, the first shaft accommodation concave part 59 is arranged in a region of the movable concave portion 67 on the rear side, the fifth connection plate 635 is arranged below the first shaft accommodation concave part 59, and the fifth connection plate 635 closes the lower side of the first shaft accommodation concave part 59.

Figure 13:
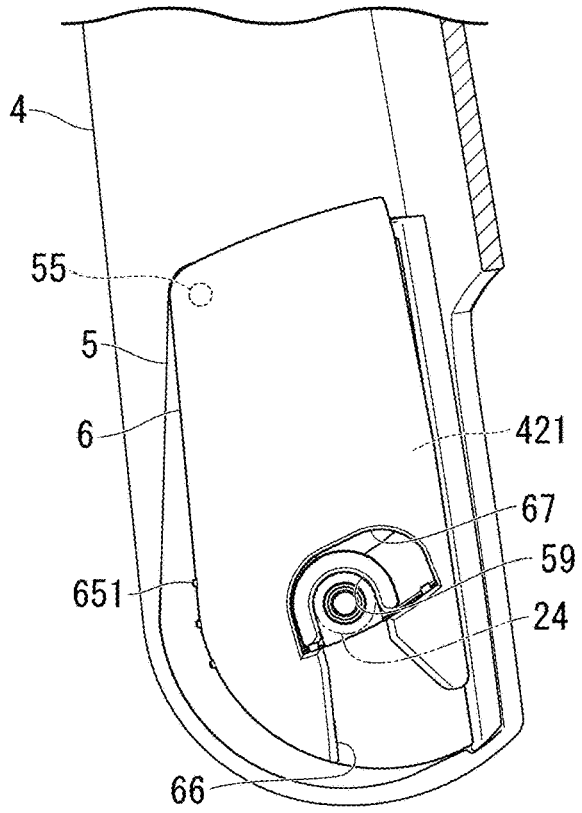
FIG. 13 is a diagram illustrating the first shaft engagement part in a non-engaged state according to some embodiments.

As illustrated in FIG. 13, in a state in which the movable portion 6 is located on the rear side in a range in which the movable portion 6 is rotatable, the first shaft accommodation concave part 59 is arranged in a region of the movable concave portion 67 on the front side, the movable groove portion 66 is arranged below the first shaft accommodation concave part 59, and the lower side of the first shaft accommodation concave part 59 is opened.

As illustrated in FIG. 7, a state in which the movable portion 6 is located on the front side (one side in a movable direction) and the lower side of the first shaft accommodation concave part 59 is closed by the fifth connection plate 635 is referred to as an "engaged state". As illustrated in FIG. 13, a state in which the movable portion 6 is located on the rear side (the other side in the movable direction) and the movable groove portion 66 is arranged below the first shaft accommodation concave part 59 is referred to as a "non-engaged state".

The spring 421 described above biases the movable portion 6 in a direction in which the movable portion 6 is in an engaged state.

As illustrated in FIG. 7, when the movable portion 6 is in an engaged state in a state in which the first shaft 24 is accommodated in the first shaft accommodation concave part 59, the movement of the first shaft 24 in the upward-downward direction and the forward-rearward direction is restrained and the first shaft 24 and the first shaft engagement part 42 are in an engaged state.

Figure 14:
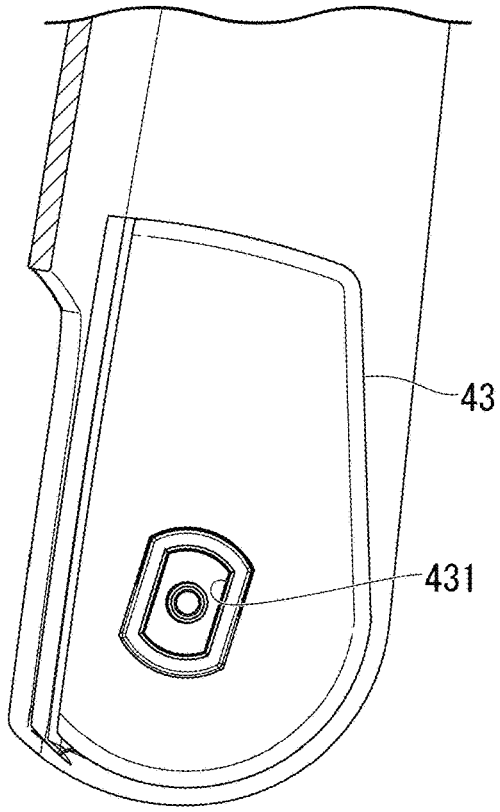
FIG. 14 is a cross-sectional view taken along line E-E of FIG. 5 according to some embodiments.

On the other hand, as illustrated in FIG. 14, in a case that the first shaft 24 is accommodated in the first shaft accommodation concave part 59, when the movable portion 6 is in a non-engaged state, the movement of the first shaft 24 in the upward-downward direction is allowed and the engagement of the first shaft 24 and the first shaft engagement part 42 is released.

When the movable portion 6 is in a non-engaged state, the first shaft 24 is configured to be able to move to the movable concave portion 67 and below the movable portion 6 via the movable groove portion 66 and to move into and outside of the movable concave portion 67.

As illustrated in FIG. 14, the second shaft engagement part 43 has a second shaft accommodation concave part 431 in which the second shaft 25 (refer to FIG. 2) is accommodated formed therein. The second shaft accommodation concave part 431 is opened toward the inner side in the width direction and the lower side thereof is closed. The second shaft accommodation concave part 431 is configured such that the second shaft 25 is inserted from the inner side in the width direction.

A method of removing the toilet lid 4 locked to the main body 2 from the main body 2 will be described below.

First, as illustrated in FIG. 1, the toilet lid 4 is erected and away from the toilet seat 3 to be in an open state.

The user grasps the lower side of the toilet lid 4 in which the first shaft engagement part 42 is provided from the front and back, pushes the pressing part 651 of the movable portion 6 of the first shaft engagement part 42 toward the main body 2 toward the rear side, and the movable portion 6 is changed from an engaged state to a non-engaged state as illustrated in FIG. 14. In this way, when the toilet lid 4 in an open state is pushed toward the main body 2, the movable portion 6 is switched from an engaged state to a non-engaged state.

When the first shaft engagement part 42 is in a non-engaged state, the user moves upward the first end side of the toilet lid 4 in the width direction so that the first shaft engagement part 42 moves away from the first shaft 24 while the pressing part 651 is pressed and removes the first shaft accommodation concave part 59 from the first shaft 24. At this time, a state in which the second shaft 25 is inserted into the second shaft engagement part 43 is provided. Thus, the toilet lid 4 does not move upward in a vertical direction and has a diagonal posture in which the first end side (a side on which the first shaft engagement part 42 is present) in the width direction is above the second end side (a side on which the second shaft engagement part 43 is present) in the width direction.

When the first shaft 24 is removed from the first shaft engagement part 42, the user moves the toilet lid 4 toward the second end side in the width direction and removes the second shaft 25 from the second shaft engagement part 43. Thus, the toilet lid 4 is removed from the main body 2.

A method of attaching the toilet lid 4 to the main body 2 will be described below.

First, the second shaft 25 is inserted into the second shaft accommodation concave part 431 by providing a posture in which the second end side of the toilet lid 4 in the width direction is positioned lower than the first end side in the width direction while the toilet lid 4 is maintained in a posture in an open state and moving the second shaft engagement part 43 from the second end side of the second shaft 25 in the width direction toward the first end side thereof.

Figure 15:
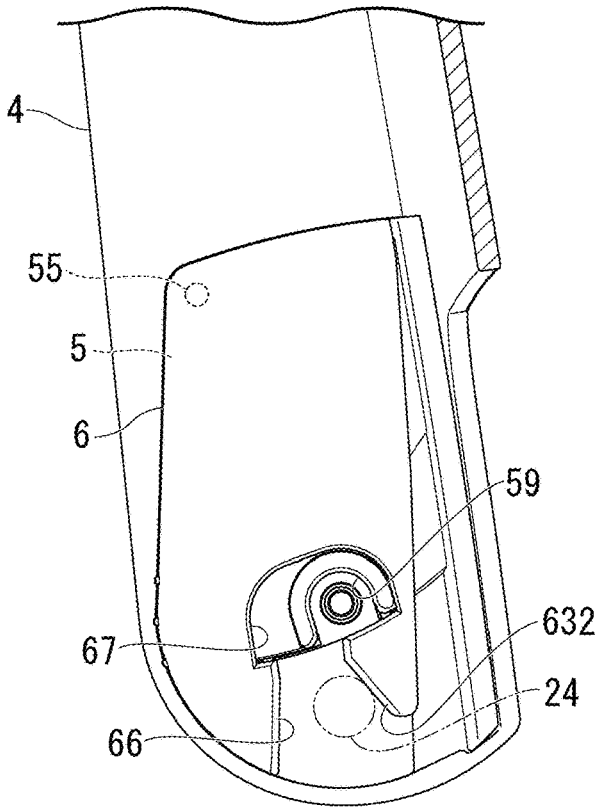
FIG. 15 is a diagram describing a state in which a first shaft is engaged with the first shaft engagement part according to some embodiments.

Subsequently, the user arranges the first shaft engagement part 42 above the first shaft 24 and moves the toilet lid 4 downward. At this time, as illustrated in FIG. 15, the first shaft 24 is brought into contact with the second connection plate 632 from below by inserting the first shaft 24 into the movable groove portion 66.

Figure 16:
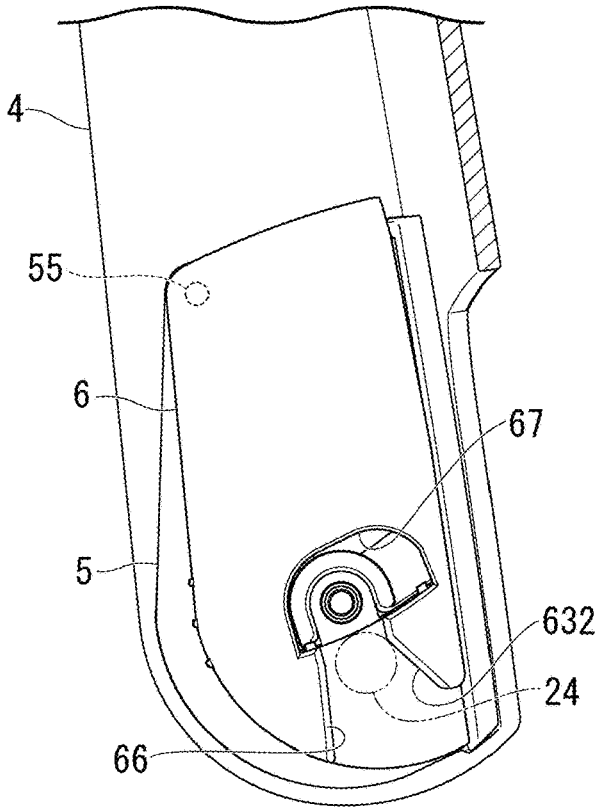
FIG. 16 is a diagram describing a state in which the first shaft is engaged with the first shaft engagement part continuing to FIG. 15 according to some embodiments.

The second connection plate 632 is gradually inclined from the lower side toward the upper side and toward the front side. When the user moves the toilet lid 4 further downward in a state in which the first shaft 24 is in contact with the second connection plate 632, the second connection plate 632 receives a reaction force from the first shaft 24 toward the rear side. Thus, as illustrated in FIG. 16, the movable portion 6 rotates toward the rear side to be in a non-engaged state.

When the movable portion 6 is in a non-engaged state, the first shaft accommodation concave part 59 is located above the movable groove portion 66 in which the first shaft 24 is arranged. For this reason, when the user moves the toilet lid 4 further downward, the first shaft 24 moves away from the second connection plate 632 and accommodated inside the first shaft accommodation concave part 59.

When the first shaft 24 moves away from the second connection plate 632 and accommodated in the first shaft accommodation concave part 59, a force pushing the movable portion 6 toward the rear side disappears. Thus, as illustrated in FIG. 7, the movable portion 6 is in an engaged state due to a restoring force of the spring 421, the fifth connection plate 635 is arranged below the first shaft 24 accommodated in the first shaft accommodation concave part 59, and the first shaft 24 is restricted in a state in which the first shaft 24 is accommodated in the first shaft accommodation concave part 59.

In this way, the toilet lid 4 is attached to the main body 2.

Although the movable portion 6 is in a non-engaged state by bringing the first shaft 24 into contact with the second connection plate 632 when the toilet lid 4 is attached to the main body 2, the user may press the pressing part 651 of the movable portion 6 so that the movable portion 6 is in a non-engaged state.

In the toilet seat device 1 according to some embodiments, when the user who is sifting on the toilet seat 3 leans against the toilet lid 4 in an open state from the front side toward the rear side as in the backrest, the toilet lid 4 is configured to be removed from the main body 2. In the following description, a description will be provided in a state in which the toilet lid 4 is opened.

Figure 18:
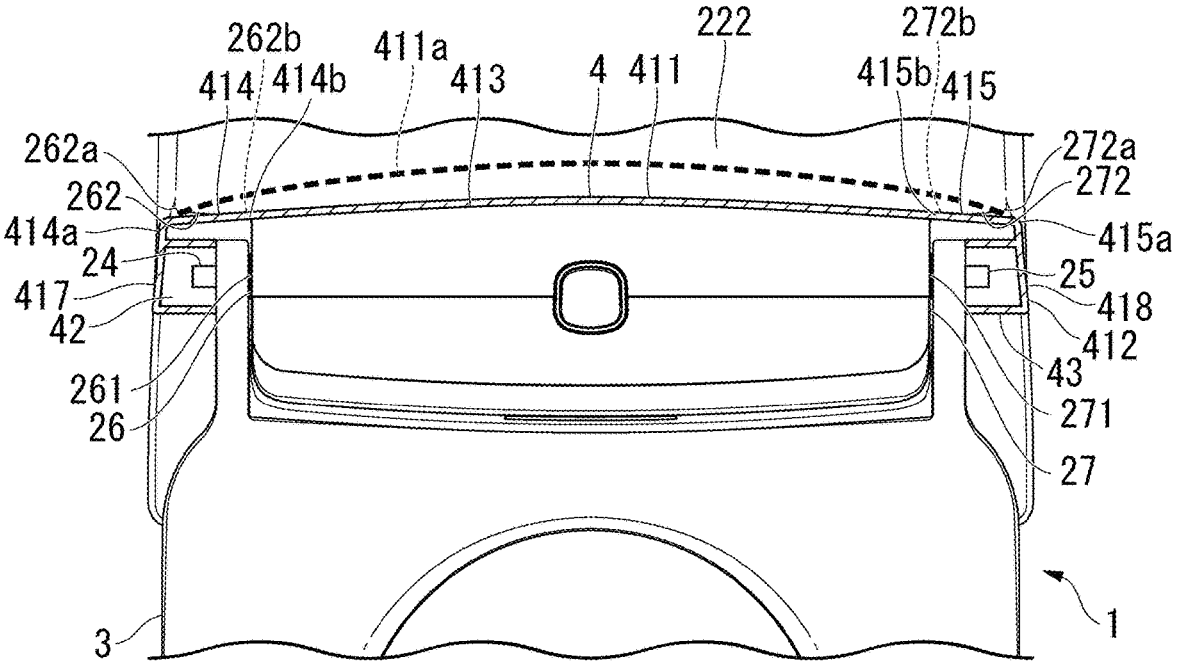
FIG. 18 is a diagram of the toilet seat device describing a state in which the toilet lid is removed and a diagram corresponding to a cross-sectional view in a horizontal direction taken along line C-C of FIG. 1 according to some embodiments.
Figure 19:
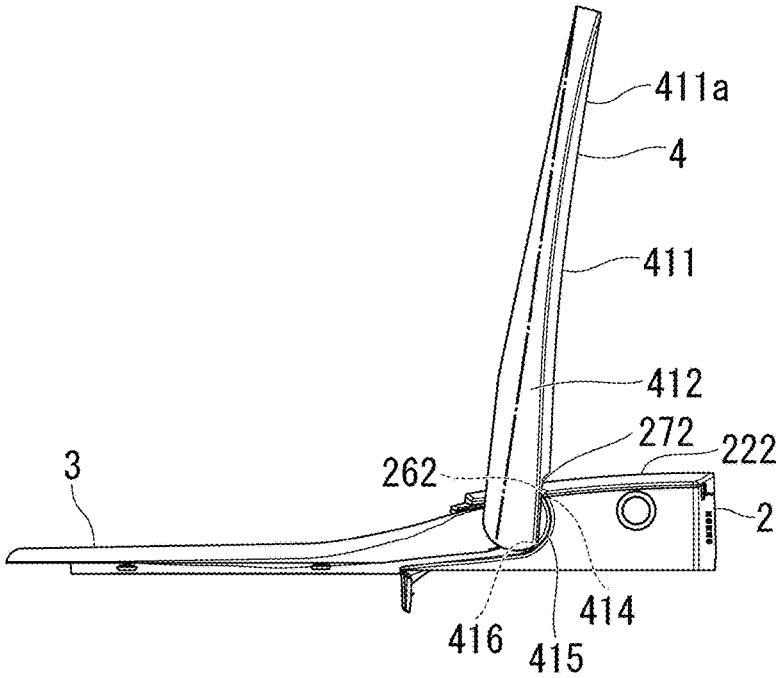
FIG. 19 is a side view of the toilet seat device corresponding to FIG. 18 according to some embodiments.
Figure 20:
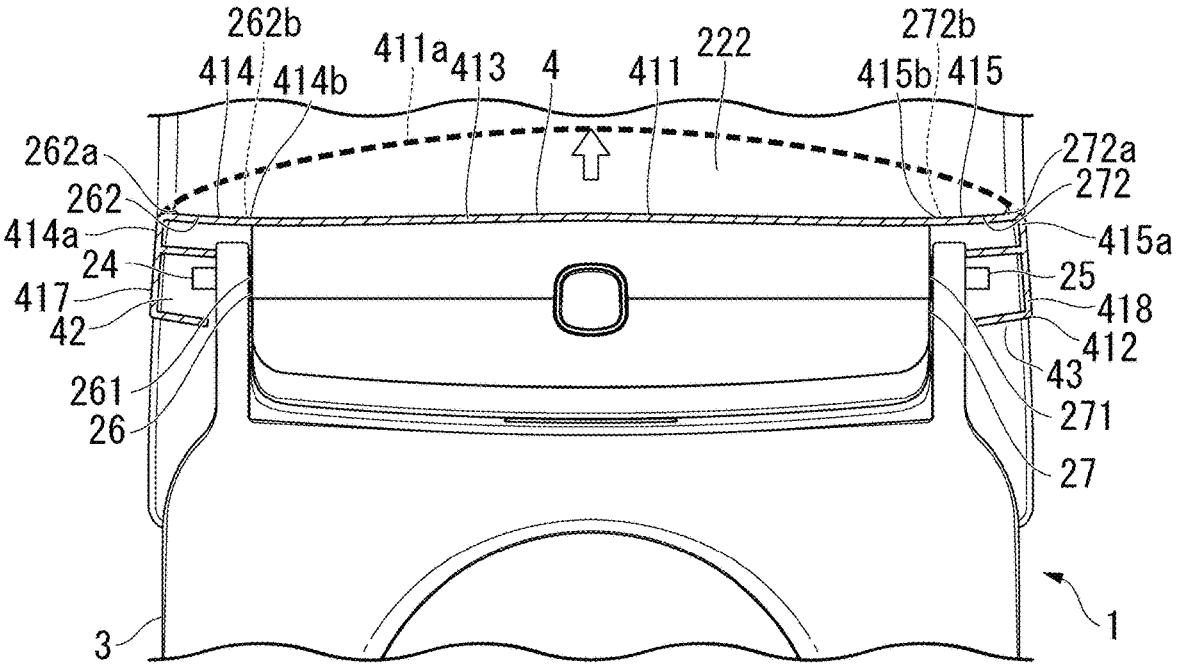
FIG. 20 is a diagram of the toilet seat device describing a state in which the toilet lid is removed continuing to FIG. 18 and a diagram corresponding to a cross-sectional view in a horizontal direction taken along line C-C of FIG. 1 according to some embodiments.
Figure 22:
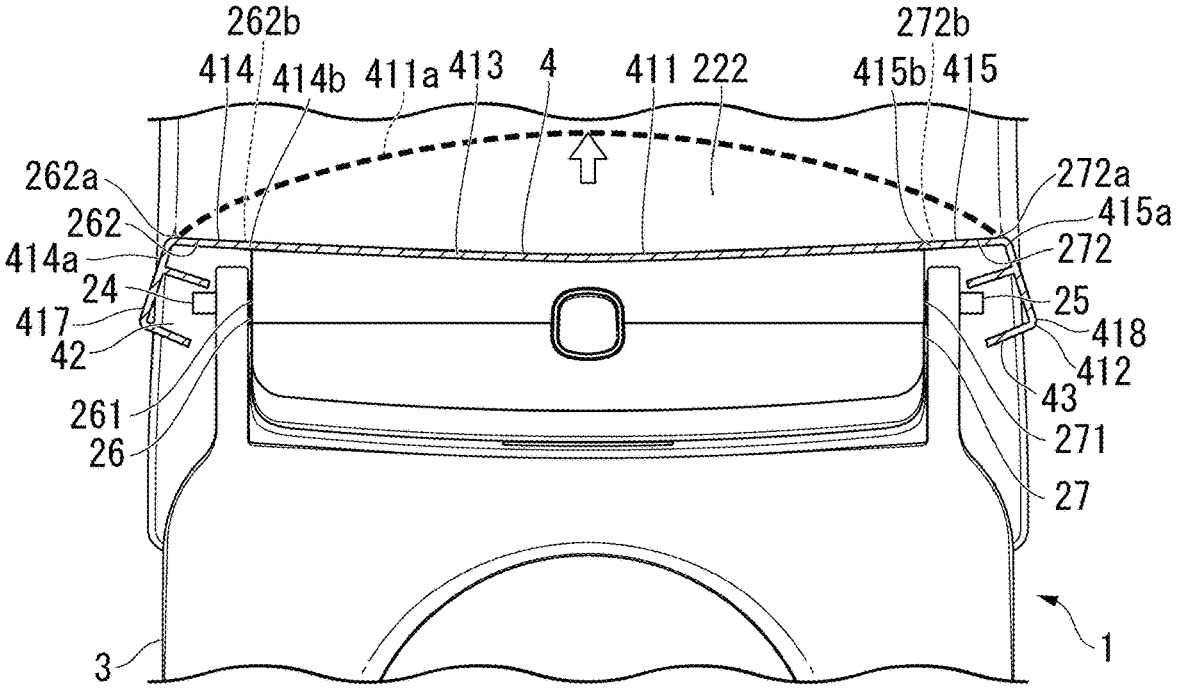
FIG. 22 is a diagram of the toilet seat device describing a state in which the toilet lid is removed continuing after FIG. 20 and a diagram corresponding to a cross section taken along line C-C of FIG. 1 according to some embodiments.

FIGS. 18 and 19 illustrate the toilet lid 4 when the user does not lean. In FIG. 18, a circumferential edge portion (a portion in which the toilet lid side plate 412 is connected) 411*a* of the toilet lid upper plate 411 is indicated by a broken line. In FIGS. 20 and 22, the circumferential edge portion (a portion in which the toilet lid side plate 412 is connected) 411*a* of the toilet lid upper plate 411 is also indicated by a broken line same as in FIG. 18.

As described above, the first attachment upper plate part 414 is arranged on the front side of the second case edge part 262 of the case upper plate part 222, the inner end part 414*b* is in contact with the inner end part 262*b* of the second case edge part 262, and a portion closer to the outer end portion 414*a* side than the inner end part 414*b* moves away from the second case edge part 262 to have a gap between the first attachment upper plate part 414 and the second case edge part 262.

The gap between the first attachment upper plate part 414 and the second case edge part 262 gradually increases from the inner end part 414*b* side toward the outer end portion 414*a* side.

The outer end portion 414*a* of the first attachment upper plate part 414 protrudes further outward in the width direction than the outer end portion 262*a* of the second case edge part 262.

The second attachment upper plate part 415 is arranged on the front side of the fourth case edge portion 272 of the case upper plate part 222, the inner end part 415*b* is in contact with the inner end part 272*b* of the fourth case edge portion 272, and a portion closer to the outer end portion 415*a* side than the inner end part 415*b* moves away from the fourth case edge portion 272 to have gap between the second attachment upper plate part 415 and the fourth case edge portion 272.

The gap between the second attachment upper plate part 415 and the fourth case edge portion 272 gradually increases from the inner end part 414*b* side toward the outer end portion 415*a* side.

The outer end portion 415*a* of the second attachment upper plate part 415 protrudes further outward in the width direction than the outer end portion 272*a* of the fourth case edge portion 272.

Figure 21:
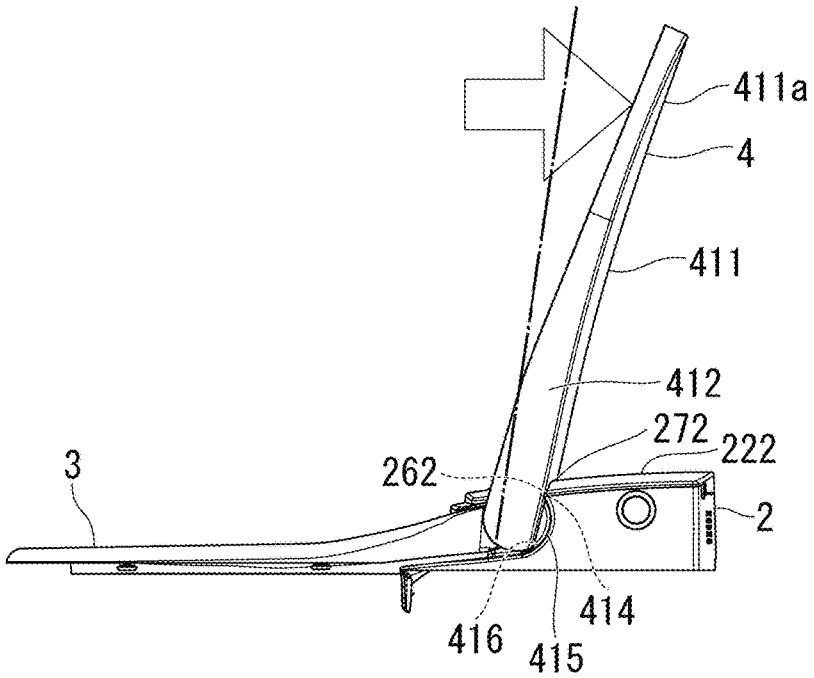
FIG. 21 is a side view of the toilet seat device corresponding to FIG. 20 according to some embodiments.

When the user leans against the toilet lid 4 from the front side toward the rear side, as illustrated in FIGS. 20 and 21, the toilet lid 4 is moved toward the rear side. The toilet lid 4 is moved toward the rear side so that a shape thereof is deflected through an arrangement in which the inner end part 414*b* of the first attachment upper plate part 414 is in contact with the second case edge part 262 and the inner end part 415*b* of the second attachment upper plate part 415 is in contact with the fourth case edge portion 272.

Thus, the first attachment upper plate part 414 is in contact with the second case edge part 262 without a gap and the second attachment upper plate part 415 is in contact with the fourth case edge portion 272 without a gap. At this time, in the first attachment upper plate part 414, the outer end portion 414*a* side is located rear side than the inner end part 414*b* side along the second case edge part 262. In addition, in the second attachment upper plate part 415, the outer end portion 415*a* is located rear side than the inner end part 415*b* side along the fourth case edge portion 272.

A portion of the toilet lid 4 above the case upper plate part 222 is moved toward the rear side and a portion thereof below the case upper plate part 222 is moved toward the front side.

Figure 23:
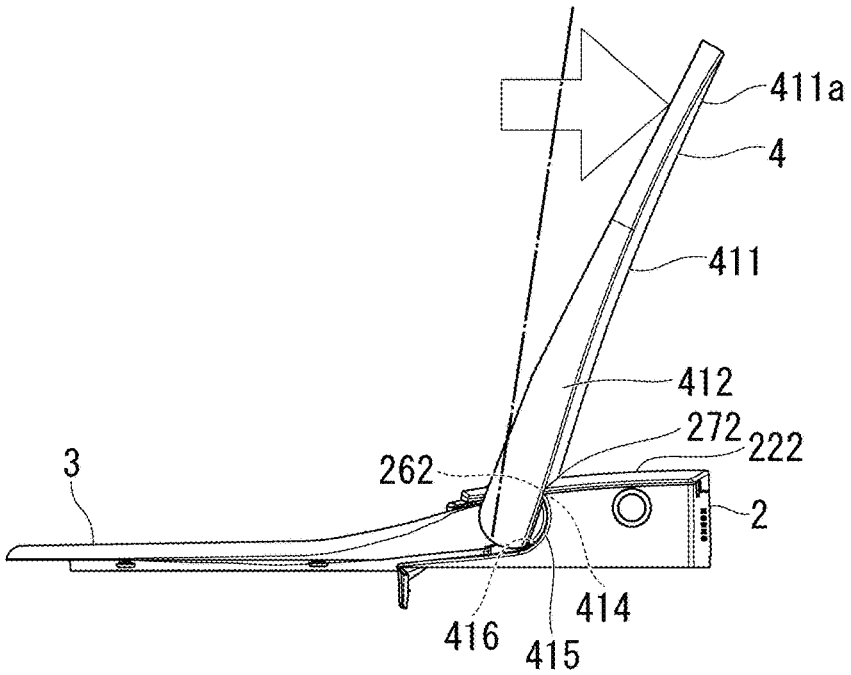
FIG. 23 is a side view of the toilet seat device corresponding to FIG. 22 according to some embodiments.

Furthermore, when the user leans against the toilet lid 4 from the front side toward the rear side, as illustrated in FIGS. 22 and 23, a portion of the toilet lid 4 above the case upper plate part 222 is moved further toward the rear side.

At this time, in a portion of the toilet lid 4 corresponding to a height of the case upper plate part 222, the first attachment upper plate part 414 is in contact with the second case edge part 262 without a gap and the second attachment upper plate part 415 is in contact with the fourth case edge portion 272 without a gap.

Here, as described above, the outer end portion 414*a* of the first attachment upper plate part 414 protrudes further outward in the width direction than the outer end portion 262*a* of the second case edge part 262 and the outer end portion 415*a* of the second attachment upper plate part 415 protrudes further outward in the width direction than the outer end portion 272*a* of the fourth case edge portion 272. For this reason, the vicinity of the outer end portion 414*a* of the first attachment upper plate part 414 and the first attachment side plate part 417 are pulled toward the rear side of the second case edge part 262 and the vicinity of the outer end portion 262*a* of the second case edge part 262 and the second attachment side plate part 418 are pulled toward the rear side of the fourth case edge portion 272. Thus, in a portion of the toilet lid 4 corresponding to a height substantially equal to that of the case upper plate part 222, both ends in the width direction are bent to be closer to the rear side than a central portion in the width direction.

When the first attachment side plate part 417 and the second attachment side plate part 418 at both ends in the width direction are pulled outward in the width direction, the first shaft engagement part 42 attached to the first attachment side plate part 417 is removed from the first shaft 24, the second shaft engagement part 43 attached to the second attachment side plate part 418 is removed from the second shaft 25, and the toilet lid 4 is removed from the main body 2.

Figure 17:
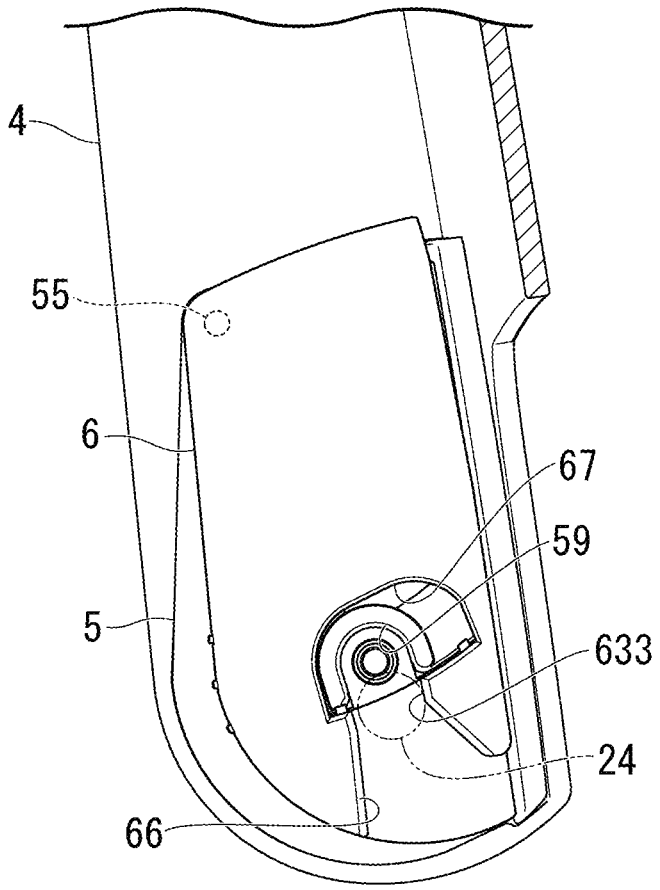
FIG. 17 is a diagram describing the first shaft engagement part when a user leans against the toilet lid according to some embodiments.

In the first attachment upper plate part 414, when the outer end portion 414*a* side is arranged to be closer to the rear side than the inner end part 414*b* side along the second case edge part 262, the first shaft engagement part 42 is moved further toward the rear side than the first shaft 24. Thus, the third connection plate 633 of the movable portion 6 is moved to a position in which the third connection plate 633 is deviated from the first shaft 24 and the first shaft 24 is in contact with the third connection plate 633 from the front side. As illustrated in FIG. 17, when the third connection plate 633 of the movable portion 6 is in contact with and pushes the first shaft 24 from the front side, the movable portion 6 is pushed toward the rear side and is in a non-engaged state. When the movable portion 6 is in a non-engaged state, the lower portion of the first shaft accommodation concave part 59 is opened. Thus, the first shaft engagement part 42 is easily removed from the first shaft 24.

An action and effects of the toilet seat device 1 according to some embodiments described above will be described below with reference to the drawings.

In the toilet seat device 1 according to some embodiments described above, the first shaft engagement part 42 in an engaged state attached to the toilet lid main body 41 presses the toilet lid main body 41 further rearward than the toilet seat 3, thus, the first shaft engagement part 42 is switched to a non-engaged state when the toilet lid main body 41 is pressed in a direction in which the toilet lid main body 41 moves away from the toilet seat 3. For this reason, the user is possible to easily switch the first shaft engagement part 42 in an engaged state to be in a non-engaged state by pressing the toilet lid main body 41 in the direction in which the toilet lid main body 41 moves away from the toilet seat 3.

Since the toilet lid 4 in which the first shaft engagement part 42 is in a non-engaged state is capable of being easily attached to and detached from the first shaft 24, the toilet lid 4 is capable of being easily attached to and detach from the main body 2.

The first shaft engagement part 42 includes the spring 421 configured to perform biasing so that a posture in a non-engaged state is changed to a posture in an engaged state. As a result, when pressing of the toilet lid main body 41 in a direction in which the toilet lid main body 41 moves away from the toilet seat 3 is stopped to make the first shaft engagement part 42 be in a non-engaged state, the first shaft engagement part 42 is capable of being easily switched in a non-engaged state to be in an engaged state.

In the toilet seat device 1 according to some above-described embodiments, when the user who is sifting on the toilet seat 3 leans against the toilet lid 4 in an open state, the toilet lid 4 is deflected so that the inner end part 414*b* of the first attachment upper plate part 414 of the toilet lid 4 comes into contact with the inner end part 262*b* of the second case edge part 262, the outer end portion 414*a* of the first attachment upper plate part 414 becomes located rear side than the inner end part 414*b*, the inner end part 415*b* of the second attachment upper plate part 415 of the toilet lid 4 is in contact with the inner end part 272*b* of the fourth case edge portion 272, and the outer end portion 415*a* of the second attachment upper plate part 415 becomes located rear side than the inner end part 415*b*.

In some embodiments, when the toilet lid 4 is deflected as described above, the first shaft engagement part 42 is removed from the first shaft 24 and the second shaft engagement part 43 is removed from the second shaft 25. Thus, it is possible to make the toilet lid 4 be in a state in which the toilet lid 4 is removed from the main body 2. In this way, in some embodiments, when the user leans against the toilet lid 4 and a load is applied to the toilet lid 4, the toilet lid 4 is capable of being prevented from becoming broken. When the toilet lid 4 is deflected, the toilet lid 4 is removed from the main body 2. Thus, it is possible to realize an arrangement in which the toilet lid 4 is removed from the main body 2 when the user leans against the toilet lid 4, regardless of a design and a material.

Since the toilet lid 4 is deflected so that the end portion side thereof in the width direction becomes located rear side than the intermediate portion thereof in the width direction, the first shaft engagement part 42 is removed from the first shaft 24. Thus, for example, when cleaning such as wiping the toilet lid 4 along its surface is performed, the toilet lid 4 is not deflected as described above. Therefore, there is no concern that the toilet lid 4 is removed from the main body 2 during cleaning.

The first shaft engagement part 42 has the first shaft accommodation concave part 59 opened downward, in which the first shaft 24 is moved into and outside of the first shaft accommodation concave part 59 from the lower side, and which is capable of accommodating the first shaft 24, and the movable portion 6 which is configured to be movable, which closes the lower portion of the first shaft accommodation concave part 59 to be in an engaged state when the movable portion 6 is located on the front side, and which opens the lower portion of the first shaft accommodation concave part 59 to be in a non-engaged state when the movable portion 6 is located on the rear side. The movable portion 6 has the second connection plate 632 with which the first shaft 24 located below the first shaft accommodation concave part 59 is capable of coming into contact from below and the second connection plate 632 is formed to have a surface which is gradually inclined from the lower side toward the upper side and from the rear side toward the front side.

In some embodiments, when the toilet lid 4 is attached to the main body 2, when the toilet lid 4 is moved downward due to its own weight while the second connection plate 632 is brought into contact with the first shaft 24 from the upper side, the second connection plate 632 (the movable portion 6) is moved downward along the first shaft 24, is moved toward the rear side due to a reaction force from the first shaft 24, and is in a non-engaged state. When the movable portion 6 is in a non-engaged state, the lower portion of the first shaft accommodation concave part 59 is opened. Thus, when the toilet lid 4 is moved further downward due to its own weight, the first shaft 24 is capable of being accommodated in the first shaft accommodation concave part 59.

In this way, the toilet lid 4 is capable of being easily attached to the main body 2 using the weight of the toilet lid 4 itself.

The movable portion 6 has the third connection plate 633 with which the first shaft 24 accommodated in the first shaft accommodation concave part 59 is capable of being brought into contact. When the toilet lid 4 is deflected so that the inner end part 414*b* of the first attachment upper plate part 414 of the toilet lid 4 in an open state is in contact with the inner end part 262*b* of the second case edge part 262 and the outer end portion 414*a* of the first attachment upper plate part 414 becomes located rear side than the inner end part 414*b*, the movable portion 6 is configured such that the first shaft 24 comes into contact with the third connection plate 633 from the front side.

In this way, the toilet lid 4 is deformed so that the inner end part 414*b* of the first attachment upper plate part 414 of the toilet lid 4 in an open state is in contact with the inner end part 262*b* of the second case edge part 262 and the outer end portion 414*a* of the first attachment upper plate part 414 becomes located rear side than the inner end part 414*b*, when the first shaft 24 comes into contact with the third connection plate 633 from the front side, the movable portion 6 is pushed toward the rear side to be in a non-engaged state. Thus, since the first shaft accommodation concave part 59 is opened, it is possible to remove the first shaft 24 is capable of being removed from the first shaft accommodation concave part 59 and the toilet lid 4 is capable of being removed from the main body 2.

In some embodiments, when the first shaft engagement part 42 is arranged further outward in the width direction than the inner end part 262*b* of the second case edge part 262, the toilet lid 4 is capable of being deflected so that a portion of the toilet lid 4 in which the first shaft engagement part 42 is provided is reliably located on the rear side. Thus, it is possible to realize a structure in which, when the user leans against the toilet lid 4 and the toilet lid 4 is deflected as described above, the toilet lid 4 is easily removed from the main body 2.

Although some embodiments will be described below with reference to the accompanying drawings, the same or similar members and portions as those in the above-described embodiments will be denoted by the same reference numerals, a description thereof will be omitted, and features different from that of the embodiments above will be described.

Figure 24:
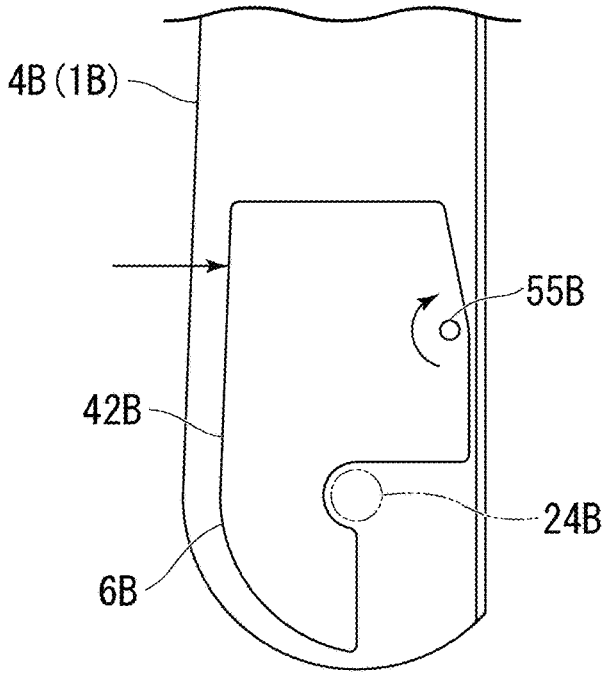
FIG. 24 is a diagram describing an engaged state of a first shaft engagement part of a toilet seat device according to some embodiments.
Figure 25:
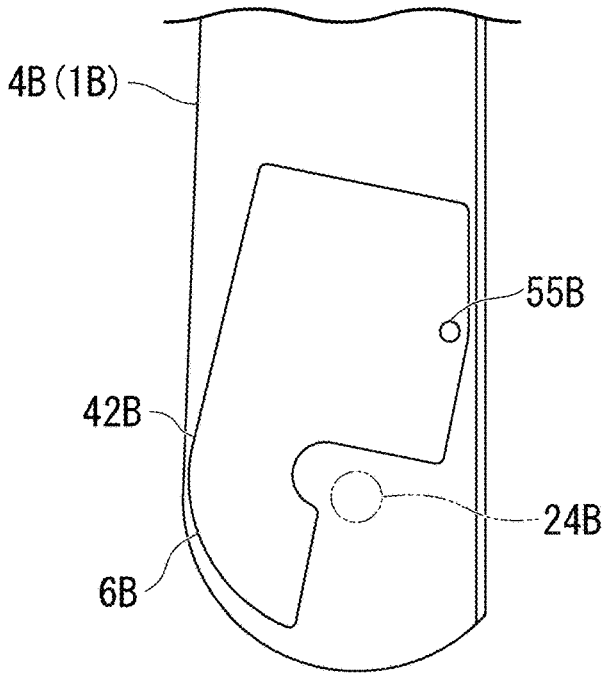
FIG. 25 is a diagram describing a non-engaged state of the first shaft engagement part of the toilet seat device according to some embodiments.

As illustrated in FIGS. 24 and 25, in a toilet seat device 1B according to the some embodiments, a position of a rotating shaft 55B of a first shaft engagement part 42B of a toilet lid 4B and a posture thereof in an engaged state or a non-engaged state are different from the positions of the first shaft engagement part 42 and the rotating shaft 55 of the toilet seat device 1 and the postures thereof in an engaged state or a non-engaged state according to some embodiments.

The first shaft engagement part 42B in some embodiments is configured such that, when the rotating shaft 55B is arranged in an intermediate portion of a movable portion 6B in a height direction thereof and a lower portion of the movable portion 6B is located on the rear side within a rotation range, a first shaft 24B is in an engagement state, and when the lower portion of the movable portion 6B is rotated to be moved toward the front side by pressing an upper portion of the movable portion 6B rearward, the movable portion 6B is in a non-engaged state in which the movable portion 6B is not engaged with the first shaft 24B.

The toilet seat device 1B according to some embodiments has the same effects as the embodiments described above.

Although the embodiment of the toilet seat device according to the present disclosure has been described above, the present disclosure is not limited to the above-described embodiments and is capable of being modified as appropriate without departing from the gist of the present disclosure.

For example, although a first shaft engagement part 42 has a spring 421 configured to perform biasing so that a posture is changed from a posture in a non-engaged state to a posture in an engaged state in the above-described embodiments, the spring 421 is not an essential constituent element. For example, the spring 421 may not be provided and one or more components enabling manually performing switching from a posture in a non-engaged state to a posture in an engaged state may be provided. Furthermore, when a biasing portion such as the spring 421 is provided in the first shaft engagement part 42, a form of the biasing portion may be a form other than the above form.

In some embodiments, a movable portion 6 has a second connection plate 632 with which the first shaft 24 located below a first shaft accommodation concave part 59 is capable of coming into contact from below. The second connection plate 632 has a surface formed to be gradually inclined from the lower side toward the upper side and from the rear side toward the front side. The toilet lid 4 is moved downward due to its own weight while the second connection plate 632 is brought into contact with the first shaft 24 from the upper side when the toilet lid 4 is attached to a main body 2. However, a portion with which the first shaft 24 comes into contact from below may not be provided.

Although the movable portion 6 of the first shaft engagement part 42 is configured to be rotated and displaced with respect to a fixed portion 5 to switch between an engaged state and a non-engaged state in some embodiments, the movable portion 6 may be configured to be displaced in the forward-rearward direction or the upward-downward direction to switch between an engaged state and a non-engaged state.

Although the toilet lid 4 is configured to be removed from the main body 2 when the user who is sitting on a toilet seat 3 leans against the toilet lid 4 in an open state as in a backrest in some embodiments, the toilet lid 4 may not be configured in this way.

In some embodiments, when the toilet lid 4 is deflected so that an inner end part 414*b* of a first attachment upper plate part 414 of the toilet lid 4 in an open state comes into contact with an inner end part 262*b* of a second case edge part 262 and an outer end portion 414*a* of the first attachment upper plate part 414 becomes located rear side than the inner end part 414*b*, when the first shaft 24 comes into contact with the third connection plate 633 from the front side, the movable portion 6 is pushed toward the rear side to be in a non-engaged state and the toilet lid 4 is removed from the main body 2 is provided. An embodiment in which the toilet lid 4 is removed from the main body 2 at the time of being deflected may be an embodiment other than the above embodiments.

When the user who is sitting on the toilet seat 3 leans against the toilet lid 4 in an open state, a position and a shape of a place of the toilet lid 4 coming into contact with the main body 2 may be set as appropriate. For example, an embodiment in which a protrusion portion protruding toward the front side is provided at a center of the main body 2 in the width direction and the toilet lid 4 comes into contact with the protrusion portion and is deflected may be provided.

Although the embodiments of the present disclosure have been described in detail above with reference to the drawings, the embodiments are not limited to the features described herein and may include design changes and the like without departing from the teachings of the present disclosure. Furthermore, the constituent elements illustrated in each of the above-described embodiments and each modification can be appropriately combined and configured.

It is possible to provide a toilet seat device in which a toilet lid is capable of being easily attached to and detached from a main body installed at an upper rear part of a toilet and a toilet seat device in which a toilet lid is capable of being prevented from becoming broken when a user leans against the toilet lid regardless of a design and a material.

It is possible to provide a toilet seat device in which a toilet lid is capable of being prevented from becoming broken when a user leans against the toilet lid regardless of a design and a material.

The invention claimed is:

1. A toilet seat device which includes:

a main body installed at an upper rear part of a toilet;

a toilet seat attached to the main body; and a toilet lid configured to rotatably attach to the main body and to open and close an upper side of the toilet seat, wherein the toilet lid includes:

a toilet lid main body configured to cover the upper portion of the toilet seat; and a shaft engagement part which is attached to the toilet lid main body and is attachable to and detachable from a shaft provided on the main body, the shaft engagement part is configured to be switchable between an engaged state and a non-engaged state, in the engaged state, the shaft engagement part is engaged with the shaft and movement of the shaft engagement part in the upward-downward direction and the forward-rearward direction is restrained and in the non-engaged state, the engagement with the shaft is released and the movement of the shaft engagement part in the upward-downward direction is allowed, and when the toilet lid is opened in the engaged state, when the toilet lid main body is pressed toward a rear side of the main body, the shaft engagement part is switched to the non-engaged state.

2. The toilet seat device of claim 1, wherein the shaft engagement part has a biasing portion configured to perform biasing so that a posture is changed from a posture in the non-engaged state to a posture in the engaged state.

3. The toilet seat device of claim 1, wherein the shaft engagement part includes:

a concave part opened downward when the toilet lid is in an open state and configured such that the shaft is capable of being put in and put out from a lower side, the concave part being configured to be capable of accommodating the shaft; and a movable portion configured to be movable, when the toilet lid is in the open state, the movable portion closing a lower portion of the concave part to be in the engaged state by moving toward one side in a movable direction, and opening the lower portion of the concave part to be in the non-engaged state by moving toward the other side in the movable direction, wherein the movable portion has an abutting portion with which the shaft located below the concave part is capable of coming into contact from below when the toilet lid is in the open state, and the abutting portion is formed on an inclined surface which is gradually inclined from the other side toward the one side in the movable direction as going from a lower side toward an upper side when the toilet lid is in the open state.

4. The toilet seat device of claim 1, wherein the shaft engagement part is attached to an end part of the toilet lid main body in a width direction, the main body has a toilet lid support portion being in contact with an intermediate portion of the toilet lid in the width direction from a rear side when the toilet lid is in an open state, and the shaft engagement part is configured to be removed from the shaft when the toilet lid is deflected so that the intermediate portion of the toilet lid in the width direction comes into contact with the toilet lid support portion when the toilet lid is in the open state and an end part of the toilet lid in the width direction becomes located rear side than the intermediate portion in the width direction.

5. The toilet seat device of claim 4, wherein the toilet seat device includes a concave part opened downward and configured such that the shaft is capable of being put in and put out from a lower side, the concave part being configured to be capable of accommodating the shaft when the toilet lid is in the open state; and a movable portion configured to be movable, when the toilet is in the open state, the movable portion closes a lower portion of the concave part to be in the engaged state by moving toward one side in a movable direction, and opening the lower portion of the concave part to be in the non-engaged state by moving toward the other side in the movable direction, wherein the movable portion has a contact portion with which the shaft accommodated in the concave part is able to come into contact, and the shaft engagement part is configured to be removed from the shaft when the toilet lid is deflected so that the intermediate portion of the toilet lid in the width direction comes into contact with the toilet lid support portion when the toilet lid is in the open state and an end part of the toilet lid in the width direction becomes located rear side than the intermediate portion in the width direction.

6. The toilet seat device of claim 4, wherein the shaft engagement part is arranged further outward in the width direction than the toilet lid support portion.

7. A toilet seat device which includes:

a main body installed at an upper rear part of a toilet;

a toilet seat attached to the main body; and a toilet lid configured to open and close an upper part of the toilet seat, wherein the toilet lid includes:

a toilet lid main body configured to close the upper part of the toilet seat; and a shaft engagement part which is attached to an end part of the toilet lid main body in a width direction and is detachably attached to a shaft provided on the main body, the main body has a toilet lid support portion being in contact with an intermediate portion of the toilet lid in the width direction from a rear side when the toilet lid is in an open state, and the shaft engagement part is configured to be removed from the shaft when the toilet lid is deflected so that the intermediate portion of the toilet lid in the width direction comes into contact with the toilet lid support portion when the toilet lid is in the open state and an end part of the toilet lid in the width direction becomes located rear side than the intermediate portion in the width direction.

8. The toilet seat device of claim 7, wherein the shaft engagement part is configured to be switchable between an engaged state in which the shaft engagement part is engaged with the shaft and a non-engaged state in which the engagement with the shaft is released, and the toilet seat device includes a concave part opened downward and configured such that the shaft is capable of being put in and put out from a lower side, the concave part being configured to be capable of accommodating the shaft; and a movable portion configured to be movable, the movable portion closing a lower portion of the concave part to be in the engaged state by moving toward one side in a movable direction, and opening the lower portion of the concave part to be in the non-engaged state by moving toward the other side in the movable direction, wherein the movable portion has a contact portion with which the shaft accommodated in the concave part is able to come into contact, and the shaft engagement part is configured to be removed from the shaft when the toilet lid is deflected so that the intermediate portion of the toilet lid in the width direction comes into contact with the toilet lid support portion when the toilet lid is in the open state and an end part of the toilet lid in the width direction becomes located rear side than the intermediate portion in the width direction.

9. The toilet seat device of claim 7, wherein the shaft engagement part is arranged further outward in the width direction than the toilet lid support portion.

10. A toilet seat device which includes:

a main body installed at an upper rear part of a toilet;

a toilet seat attached to the main body; and a toilet lid configured to rotatably attached to the main body and to open and close upper side of the toilet seat, wherein the toilet lid includes:

a toilet lid main body configured to cover the upper portion of the toilet seat; and a shaft engagement part which is attached to the toilet lid main body and is attachable to and detachable from a shaft provided on the main body, the shaft engagement part is configured to be switchable between an engaged state in which the shaft engagement part is engaged with the shaft and a non-engaged state in which the engagement with the shaft is released, when the toilet lid is opened in the engaged state, when the toilet lid main body is pressed in a direction in which the toilet lid main body moves away from the toilet seat in the engaged state, the shaft engagement part is switched to the non-engaged state, the shaft engagement part has a biasing portion configured to perform biasing so that a posture is changed from a posture in the non-engaged state to a posture in the engaged state.

* * * * *